US011835898B2

(12) United States Patent
Matsuda et al.

(10) Patent No.: US 11,835,898 B2
(45) Date of Patent: Dec. 5, 2023

(54) ADHESION APPARATUS FOR FORMING IMAGE OF POWDER ADHESIVE, AND IMAGE FORMING APPARATUS

(71) Applicant: CANON KABUSHIKI KAISHA, Tokyo (JP)

(72) Inventors: Kohei Matsuda, Kanagawa (JP); Taku Watanabe, Shizuoka (JP); Shun Sato, Kanagawa (JP); Tsutomu Shimano, Shizuoka (JP); Yuki Nishizawa, Kanagawa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 25 days.

(21) Appl. No.: 17/383,718

(22) Filed: Jul. 23, 2021

(65) Prior Publication Data

US 2022/0035288 A1 Feb. 3, 2022

(30) Foreign Application Priority Data

Jul. 31, 2020 (JP) ..... 2020-130772
Jul. 31, 2020 (JP) ..... 2020-130773

(51) Int. Cl.

| | |
|---|---|
| ***G03G 15/24*** | (2006.01) |
| ***G03G 21/20*** | (2006.01) |
| ***G03G 15/22*** | (2006.01) |
| ***G03G 15/00*** | (2006.01) |
| ***G03G 15/02*** | (2006.01) |

(52) U.S. Cl.

CPC ..... *G03G 15/24* (2013.01); *G03G 15/0275* (2013.01); *G03G 15/221* (2013.01); *G03G 15/6544* (2013.01); *G03G 15/6585* (2013.01); *G03G 21/203* (2013.01); *G03G 2215/00426* (2013.01); *G03G 2215/00835* (2013.01)

(58) Field of Classification Search

CPC .. G03G 15/0275; G03G 15/221; G03G 15/24; G03G 15/6544; G03G 15/6585; G03G 21/203; G03G 2215/00426; G03G 2215/00835

See application file for complete search history.

(56) References Cited

U.S. PATENT DOCUMENTS 7,260,354 B2 * 8/2007 Ishida ..... G03G 15/2064 399/407
2006/0133871 A1 6/2006 Ishida

FOREIGN PATENT DOCUMENTS

| | | | |
|---|---|---|---|
| JP | 2006171607 | A | 6/2006 |
| JP | 2007193004 | A | 8/2007 |
| JP | 2008036957 | A | 2/2008 |
| JP | 2008162029 | A | 7/2008 |

* cited by examiner

*Primary Examiner* — Joseph S Wong
(74) *Attorney, Agent, or Firm* — ROSSI, KIMMS & McDOWELL LLP

(57) ABSTRACT

An adhesion apparatus includes: an image forming unit configured to form, through an electrophotographic process, an adhesive image of a powder adhesive on a sheet that is conveyed; and a control unit configured to control the image forming unit to use a first pattern in a first conveyance period, and use a second pattern different from the first pattern in a second conveyance period following the first conveyance period, as a formation pattern in an adhering section corresponding to part of a width direction orthogonal to a conveyance direction of the sheet.

8 Claims, 16 Drawing Sheets

FIG. 14A

| TEMPERATURE, HUMIDITY | | 23°C, 50% | 15°C, 10% | 15°C, 10% |
|---|---|---|---|---|
| PROCESS CARTRIDGE | | INITIAL STATE | INITIAL STATE | TERMINAL STATE |
| ΔI | 3 | OK | FOURTH NG | THIRD,FOURTH NG |
| | 5 | OK | OK | FOURTH NG |
| | 8 | OK | OK | OK |

FIG. 14B

| THIRD EMBODIMENT (ΔK=2) | COMPARATIVE EXAMPLE (ΔK=0) |
|---|---|
| OK | FOURTH NG |

ADHESION APPARATUS FOR FORMING IMAGE OF POWDER ADHESIVE, AND IMAGE FORMING APPARATUS

BACKGROUND OF THE INVENTION

Field of the Invention

The present invention relates to a technique for forming an image of a powder adhesive on a sheet through an electrophotographic process.

Description of the Related Art

US-2006-133871, Japanese Patent Laid-Open No. 2007-193004, Japanese Patent Laid-Open No. 2008-36957, and Japanese Patent Laid-Open No. 2008-162029 disclose an apparatus that forms a toner image by causing toner to adhere to a sheet through an electrophotographic process, and that also causes powder adhesive to adhere to a sheet through an electrophotographic process. The sheet to which the powder adhesive has adhered is folded, and is then heated and pressurized. As a result, opposing regions of the folded sheet are bonded to each other by the powder adhesive.

For example, when a sheet is folded to form a bag, it is necessary to cause the powder adhesive to adhere to the sheet continuously in a conveyance direction in a section that occupies at least one end of the sheet in a width direction orthogonal to the conveyance direction. This means that the powder adhesive is continuously supplied to a photosensitive member from the same position in the direction of the rotation axis of a developing roller (which corresponds to the width direction of the sheet). When the powder adhesive is continuously supplied to the photosensitive member from the same position in the direction of the rotation axis of the developing roller, the amount of powder adhesive supplied to the photosensitive member from that position of the developing roller will gradually decrease, and thus the amount of powder adhesive adhering to the sheet will also decrease in the stated section. The adhesive strength will drop in areas with a low amount of adhering powder adhesive, and there is thus a risk that the quality of the bag serving as the final product will be insufficient.

SUMMARY OF THE INVENTION

According to an present disclosure, an adhesion apparatus includes: an image forming unit configured to form, through an electrophotographic process, an adhesive image of a powder adhesive on a sheet that is conveyed; and a control unit configured to control the image forming unit to use a first pattern in a first conveyance period, and use a second pattern different from the first pattern in a second conveyance period following the first conveyance period, as a formation pattern in an adhering section corresponding to part of a width direction orthogonal to a conveyance direction of the sheet.

Further features of the present invention will become apparent from the following description of exemplary embodiments with reference to the attached drawings.

BRIEF DESCRIPTION OF THE DRAWINGS

FIGS. 14A and 14B are descriptive diagrams illustrating results according to an embodiment.

DESCRIPTION OF THE EMBODIMENTS

Figure 1:
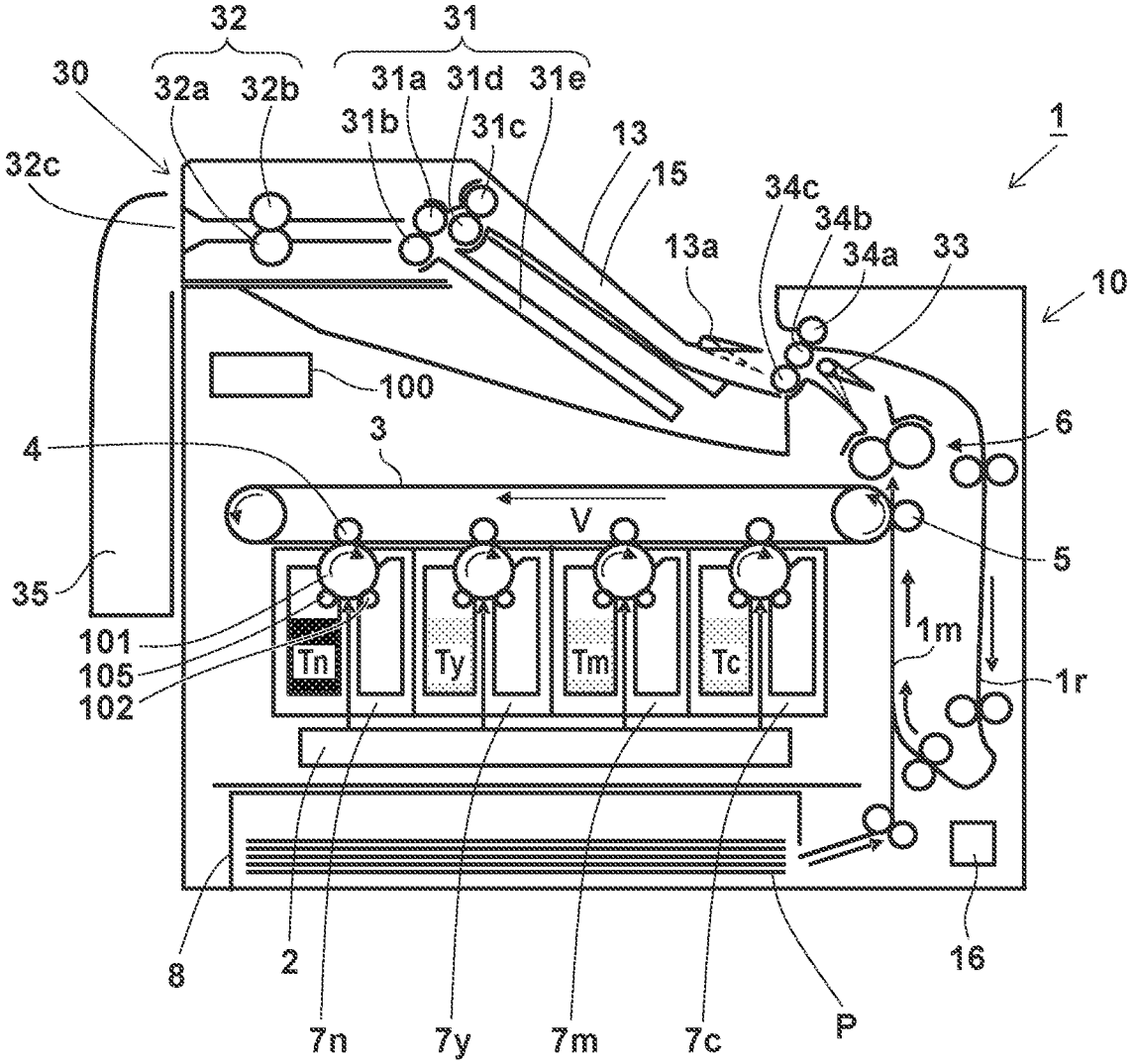
FIG. 1 is a schematic diagram illustrating an image forming apparatus according to an embodiment.

Hereinafter, embodiments will be described in detail with reference to the attached drawings. Note, the following embodiments are not intended to limit the scope of the claimed invention. Multiple features are described in the embodiments, but limitation is not made to an invention that requires all such features, and multiple such features may be combined as appropriate. Furthermore, in the attached drawings, the same reference numerals are given to the same or similar configurations, and redundant description thereof is omitted.

First Embodiment

An example of an image forming apparatus capable of forming both a toner image and an adhesive image on a sheet will be described here as one embodiment of an adhesion apparatus. However, unless stated otherwise, the mechanism described below can also be applied to adhesion apparatuses that adhere adhesive to a sheet, without forming a toner image.

FIG. 1 is a schematic diagram of an image forming apparatus 1 that forms an image through an electrophotographic process, according to the present embodiment. The image forming apparatus 1 includes an image forming unit 10 and a post-processing unit 30. On the basis of image data, the image forming unit 10 forms a toner image on a sheet P, which is stored in a cassette 8 in advance and conveyed along a conveyance path, and causes a powder adhesive to adhere to the sheet P. The powder adhesive adhering to the sheet P forms a given two-dimensional pattern, and the corresponding image is called an "adhesive image". In the present specification, the term "image" is assumed to include toner images and adhesive images. "Electrophotographic process" generally refers to the process of forming an electrostatic latent image on a photosensitive member, developing the electrostatic latent image with powder to generate a powder image, and transferring the powder image from the photosensitive member to a sheet. If the powder used is toner, the powder image is a toner image, whereas if the powder used is powder adhesive, the powder image is an adhesive image. The image forming unit 10 includes four process cartridges 7*n*, 7*y*, 7*m*, and 7*c*, and a primary transfer roller 4 corresponding to each of the process cartridges 7*n*, 7*y*, 7*m*, and 7*c*. Each of the process cartridges 7*n*, 7*y*, 7*m*, and 7*c* is a replaceable part of the image forming apparatus 1, and is configured to be removable and attachable from and to the main body of the image forming apparatus 1.

Each of the process cartridges 7*n*, 7*y*, 7*m*, and 7*c* has the same configuration, and these will therefore collectively be referred to as "process cartridge 7" hereinafter. However, different types of powders are stored in the process cartridges 7*y*, 7*m* and 7*c*, and the process cartridge 7*n*. Specifically, powder of the type "toner" is stored in the process cartridges 7*y*, 7*m* and 7*c*, and powder of the type "powder adhesive" is stored in the process cartridge 7*n*. The colors of the toner stored in the process cartridges 7*y*, 7*m*, and 7*c* are yellow, magenta, and cyan, respectively.

Figure 2:
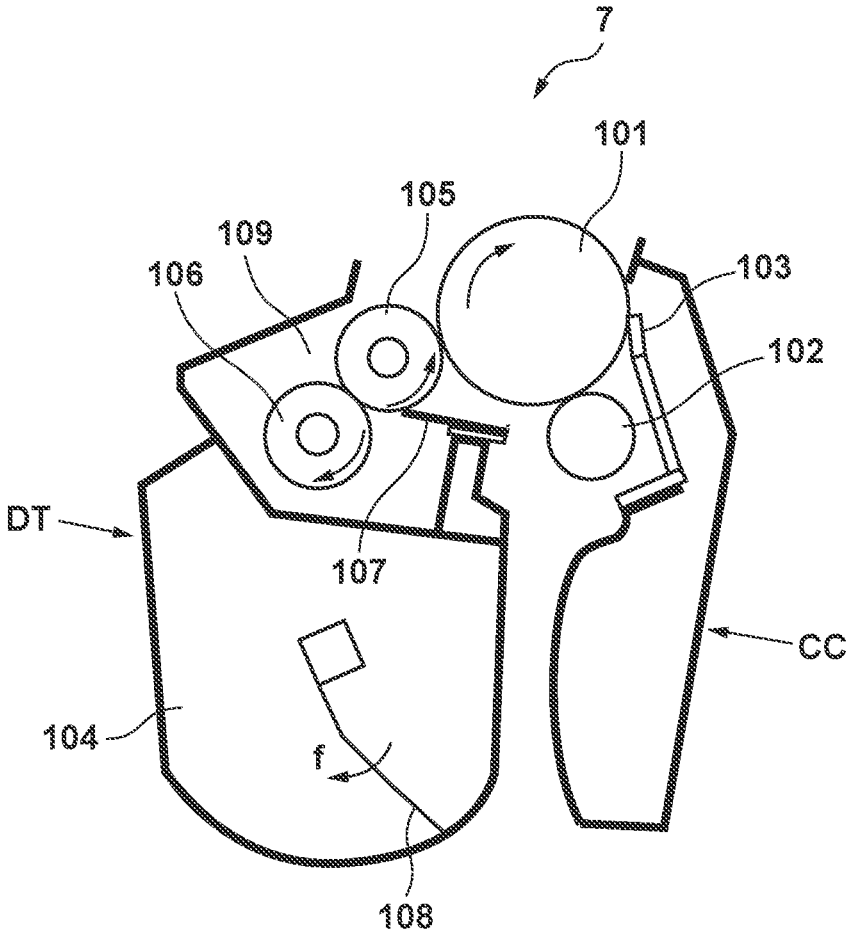
FIG. 2 is a schematic diagram illustrating a process cartridge according to an embodiment.

FIG. 2 is a schematic diagram illustrating the process cartridge 7. The process cartridge 7 includes a photosensitive member unit CC and a developing unit DT. The photosensitive member unit CC includes a photosensitive member 101, a charging roller 102, and a cleaning member 103, and the developing unit DT includes the remaining members illustrated in FIG. 2. During image formation, the photosensitive member 101 is rotationally driven in the clockwise direction in FIG. 2. The charging roller 102 charges the surface of the photosensitive member 101 to a uniform potential by outputting a charging voltage. The surface of the charged photosensitive member 101 is exposed by laser light emitted by a scanner unit 2 (FIG. 1), and an electrostatic latent image is formed on the photosensitive member 101 as a result.

A holding part 104 of the developing unit DT holds the powder (toner or powder adhesive) to be supplied to a supply roller 106 and a developing roller 105. A transport member 108 is rotationally driven in the clockwise direction (the direction of arrow f) in FIG. 2. As a result, the powder held in the holding part 104 is agitated and transported to a developing chamber 109. The supply roller 106 is rotationally driven in the clockwise direction in FIG. 2, and supplies powder to the developing roller 105 as well as stripping powder remaining on the developing roller 105 from the developing roller 105. A developing blade 107 is provided to regulate the thickness of the powder on the developing roller 105. The developing roller 105 is rotationally driven in the counterclockwise direction in FIG. 2, and outputs a developing voltage. The developing voltage causes the powder carried by the developing roller 105 to adhere to the electrostatic latent image (the exposed region) of the photosensitive member 101. In other words, the developing roller 105 supplies powder to the photosensitive member while rotating. As a result, in the case of the process cartridges 7*y*, 7*m* and 7*c*, yellow, magenta, and cyan toner images, respectively, are formed on the photosensitive member 101. In the case of the process cartridge 7*n*, an adhesive image is formed on the photosensitive member 101. The photosensitive member 101 carries the formed image (the toner image or the adhesive image). In the following descriptions, the toner images formed by the process cartridges 7*y*, 7*m*, and 7*c*, and the adhesive image formed by the process cartridge 7*n*, may be collectively referred to as "powder images". Although not illustrated in the drawings, the process cartridge 7 may further include non-volatile memory that stores information such as a usage history of the process cartridge 7 and the remaining amount of powder.

Returning to FIG. 1, the primary transfer roller 4, which is provided for each process cartridge 7, transfers the powder image of each photosensitive member 101 to a transfer belt 3 by outputting a primary transfer voltage. The transfer belt 3 is rotationally driven in the counterclockwise direction (the direction indicated by V) in FIG. 1 during image formation. Colors other than yellow, magenta, and cyan can be formed by transferring the toner images formed on each photosensitive member 101 of the process cartridges 7*y*, 7*m*, and 7*c* to the transfer belt 3 in an overlapping manner. For example, black can be formed as process black in which yellow, magenta, and cyan toner are superimposed. The powder image transferred to the transfer belt 3 is conveyed to a position opposite a secondary transfer roller 5.

The sheet P stored in the cassette 8 is fed to a main conveyance path 1*m* and conveyed to the position opposite the secondary transfer roller 5. The secondary transfer roller 5 transfers the powder image on the transfer belt 3 to the sheet P by outputting a secondary transfer voltage. In this manner, the process cartridge 7, the primary transfer roller 4, the scanner unit 2, the transfer belt 3, and the secondary transfer roller 5 constitute an image forming section that forms the powder image on the sheet P.

After the transfer of the powder image, the sheet P is conveyed to a first fixing device 6. The first fixing device 6 heats and pressurizes the sheet P to fix the powder image to the sheet P. When forming powder images on both sides of the sheet P, a flapper 33 is set to guide the sheet P to a nip area between a first discharge roller 34*a* and an intermediate roller 34*b*, as indicated by the dotted line in FIG. 1. The sheet P is then pinched and conveyed toward a discharge tray 13 by the first discharge roller 34*a* and the intermediate roller 34*b*. When a following edge of the sheet P passes the flapper 33, the rotation direction of the first discharge roller 34*a* and the intermediate roller 34*b* is switched to the direction opposite from that used up until that point. Additionally, as indicated by the solid line in FIG. 1, the flapper 33 is set to a direction that guides the sheet P to a double-sided conveyance path 1*r*. Then, the sheet P is again conveyed through the double-sided conveyance path 1*r* to a position opposite the secondary transfer roller 5, which is an image forming position (transfer position).

The sheet P on both sides of which a powder image is formed, or, when a powder image is formed on only one side of the sheet P, the sheet P on one side of which a powder image is formed, is pinched and conveyed by a second discharge roller 34*c* and the intermediate roller 34*b* after passing through the first fixing device 6. At this time, the flapper 33 is set to guide the sheet P to a nip area between the second discharge roller 34*c* and the intermediate roller 34*b*, as indicated by the solid line in FIG. 1.

A sheet P on which no adhesive image is formed and which therefore does not require post-processing by the post-processing unit 30 is discharged to the discharge tray 13. At this time, a flapper 13*a* is set to a direction that guides the sheet P to the discharge tray 13, as indicated by the broken line in FIG. 1. On the other hand, a sheet P on which an adhesive image is formed and which therefore requires post-processing by the post-processing unit 30 is conveyed toward an intermediate path 15 of the post-processing unit 30. At this time, the flapper 13*a* is set to a direction that guides the sheet P to the intermediate path 15, as indicated by the solid line in FIG. 1.

Figure 3A:
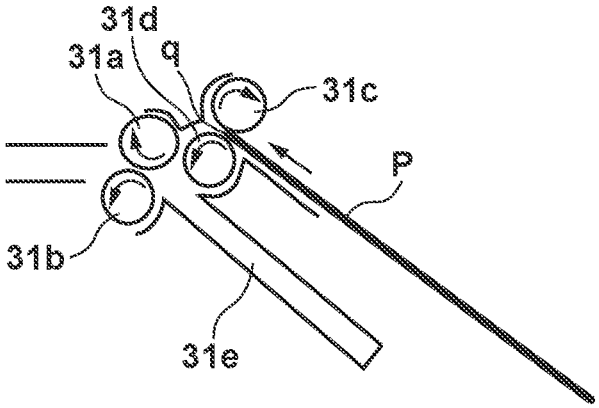
FIGS. 3A to 3F are descriptive diagrams illustrating processing performed by a folding device according to an embodiment.

The post-processing unit 30, which is provided downstream from the first fixing device 6 in the conveyance direction, includes a folding device 31, a second fixing device 32, and a discharge unit 35. Folding processing for folding the sheet P is executed by the folding device 31. FIGS. 3A to 3F are descriptive diagrams illustrating the folding processing. FIG. 3A illustrates a state in which the sheet P is pinched and conveyed in the intermediate path 15 by a first guide roller 31*c* and a second guide roller 31*d*. Once a leading edge q of the sheet P passes the position of the first guide roller 31*c* and the second guide roller 31*d*, the leading edge q of the sheet P is guided downward in FIG. 3A by a guide wall 31*f* (FIG. 3B). Then, as illustrated in FIG. 3B, the leading edge q of the sheet P is pulled by a first folding roller 31*a* and the second guide roller 31*d*, which oppose each other, and contacts a wall 31*g* of a pull-in part 31*e*. Then, by being pushed by the first guide roller 31*c* and the second guide roller 31*d*, the sheet P advances toward the rear of the pull-in part 31*e* while sliding against the wall 31*g*. Next, as illustrated in FIG. 3C, the leading edge q butts against an end part 31*h* of the pull-in part 31*e*. As illustrated in FIG. 1, the pull-in part 31*e* is formed substantially parallel to the intermediate path 15 below the intermediate path 15, and thus at the stage indicated by FIG. 3C, the sheet P is wrapped around the second guide roller 31*d* and bent into a U shape.

Figure 3D:
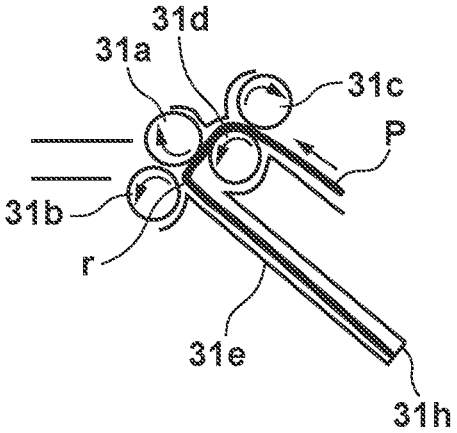
Figure 3B:
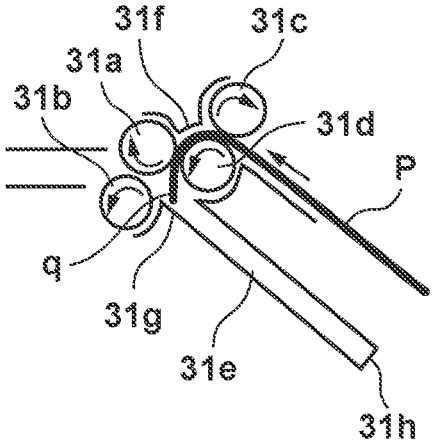
Figure 3E:
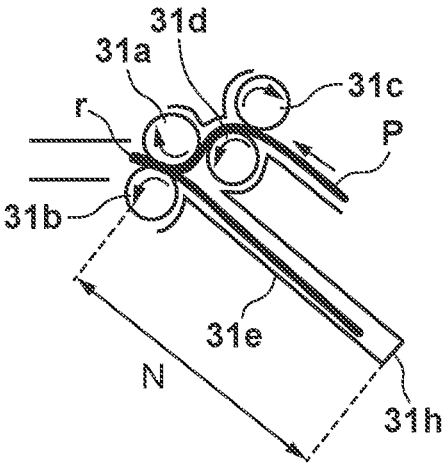
Figure 3C:
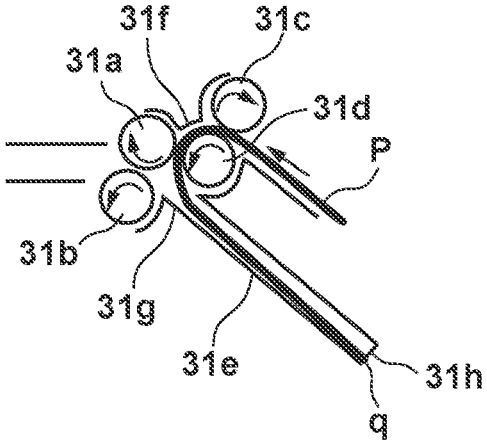
Figure 3F:
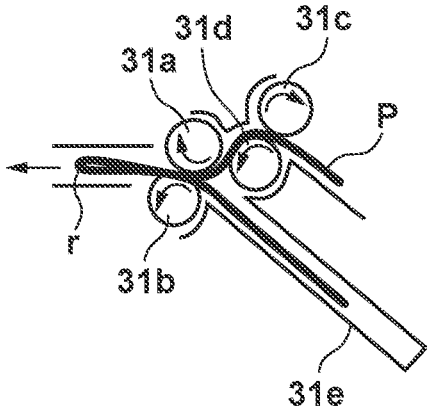

When the sheet P is pushed further from the state illustrated in FIG. 3C by the first guide roller 31*c* and the second guide roller 31*d*, a middle position r of the sheet P flexes, as indicated in FIG. 3D. When the middle position r, which has flexed, contacts a second folding roller 31*b*, the middle position r of the sheet P is pulled into a nip area between the first folding roller 31*a* and the second folding roller 31*b* by friction received from the second folding roller 31*b*, as illustrated in FIG. 3E. Then, as indicated in FIG. 3F, the sheet P is pinched and conveyed by the first folding roller 31*a* and the second folding roller 31*b* while folded with the middle position r corresponding to the crease, and is discharged from the folding device 31 with the middle position r corresponding to a leading edge side.

When the length of the sheet P in the conveyance direction is represented by L, a depth N of the pull-in part 31*e* (FIG. 3E) can be set to L/2. Note that the depth N of the pull-in part 31*e* is the distance from the nip area between the first folding roller 31*a* and the second folding roller 31*b* to the end part 31*h* of the pull-in part 31*e*. By setting the depth N in this manner, the folding device 31 performs processing for folding the sheet P in two (saddle folding) at a position halfway along the sheet P in the conveyance direction. Note that the depth N of the pull-in part 31*e* is not limited to half the length L of the sheet P in the conveyance direction. The depth N of the pull-in part 31*e* can be adjusted as desired in accordance with the position of the crease in the sheet P.

Note also that the configuration of the folding device 31 is not limited to the configuration illustrated in FIGS. 3A to 3F. For example, a folding mechanism that forms a crease by pushing a blade against the sheet P to push the sheet P into a nip area between a pair of rollers can be used as well. Additionally, the folding processing is not limited to folding the sheet in two, and folding processing such as Z folding, folding the sheet into three, and so on can also be performed. The folding device 31 according to the present embodiment is constituted by the pull-in part 31*e*, which is fixed, and a rotating roller, and the drive mechanism can therefore be simplified compared to a folding mechanism which uses a blade that moves in a reciprocating manner. Additionally, the folding device 31 according to the present embodiment only requires the pull-in part 31*e*, which has a depth N equivalent to half the length of the sheet, to be provided in addition to the four rollers, which makes it possible to make the post-processing unit 30 smaller.

Returning to FIG. 1, the sheet P, which has passed through the folding device 31, is conveyed to the second fixing device 32. The second fixing device 32 has the same fixing configuration as the first fixing device 6. Specifically, the second fixing device 32 includes a heating roller 32*b* serving as a heating member, and a pressure roller 32*a* serving as a pressure member. The heating roller 32*b* is heated by a heating element such as a halogen lamp or a ceramic heater, a heating mechanism using induction heating, or the like. The pressure roller 32*a* is pressed against the heating roller 32*b* by a biasing member such as a spring, and produces pressure for pressurizing the sheet P passing through a nip area between the heating roller 32*b* and the pressure roller 32*a* (a pressure bonding nip).

The sheet P, which has been folded by the folding device 31, is heated and pressurized by the second fixing device 32. In other words, the second fixing device 32 heats and re-melts the powder adhesive forming the adhesive image adhering to the sheet P, and causes opposing regions of the folded sheet P to adhere to each other using the pressure. After passing through the second fixing device 32, powder adhesive Tn cools and hardens, which causes the opposing regions of the sheet P to adhere to each other across the crease. The sheet P, which has passed through the second fixing device 32, is discharged to the discharge unit 35.

Figure 4:
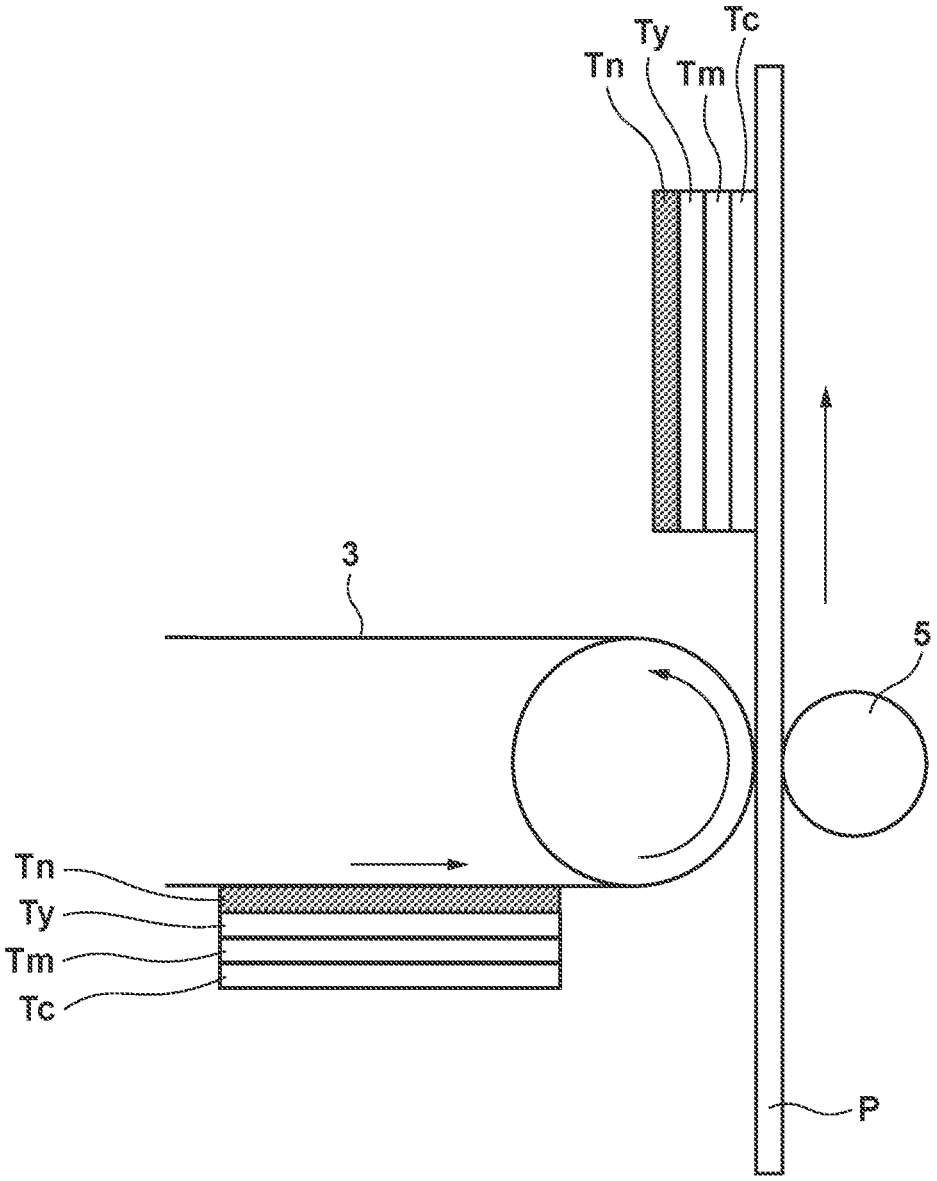
FIG. 4 is a diagram illustrating a positional relationship between each of powders adhering to a sheet according to an embodiment.

Note that as illustrated in FIG. 1, in the present embodiment, the powder images are transferred to the transfer belt 3 in the order of the process cartridges 7*n*, 7*y*, 7*m*, and 7*c*. Accordingly, as illustrated in FIG. 4, when three color toner images and an adhesive image are superimposed, the adhesive image of the powder adhesive Tn is the lowermost layer on the transfer belt 3 (the layer in contact with the transfer belt 3), and the yellow (Ty), magenta (Tm), and cyan (Tc) toner images are superimposed thereon in that order. As such, the adhesive image is the uppermost layer on the sheet P, as illustrated in FIG. 4. Having the adhesive image be the uppermost layer makes it possible for the second fixing device 32 to cause the opposing regions of the folded sheet P to adhere to each other.

A variety of publicly-known toners can be used for the toners Ty, Tm, and Tc. For example, a toner using a thermoplastic resin as the binding resin can be used. Toners made of polyester resin, vinyl resin, acrylic resin, styrene acrylic resin, or the like can also be used. In addition, the toner can contain colorants, magnetic materials, charge control agents, waxes, and external additives.

A powder adhesive containing thermoplastic resin can be used for the powder adhesive Tn. The powder adhesive Tn may contain a publicly-known thermoplastic resin such as polyester resin, vinyl resin, acrylic resin, styrene acrylic resin, polyethylene, polypropylene, polyolefin, ethylene-vinyl acetate copolymer resin, ethylene-acrylic acid copolymer resin, or the like. The powder adhesive Tn may also contain wax. Specifically, the powder adhesive Tn can contain, for example, an ester wax, which is an ester of alcohol and acid, and a hydrocarbon wax such as paraffin wax. The powder adhesive Tn may further contain a colorant. Publicly-known colorants such as black colorants, yellow colorants, magenta colorants, and cyan colorants can be used as the colorants. The content of the colorant in the powder adhesive Tn can be less than or equal to 1.0% by mass. Additionally, the content of the colorant in the powder adhesive Tn can be less than or equal to 0.1% by mass. Furthermore, the powder adhesive Tn can contain magnetic materials, charge control agents, waxes, and external additives.

To cause the powder adhesive Tn to adhere to the sheet P using the electrophotographic method, for example, a powder adhesive Tn having a weight average particle diameter of greater than or equal to 5.0 μm and less than or equal to 30 μm can be used. Toner used for printing can also be used as the powder adhesive Tn, as long as the toner satisfies the necessary adhesive properties.

A temperature/humidity sensor 16 of the image forming apparatus 1 obtains the ambient temperature and humidity of the image forming apparatus 1 as environment information. A control unit 100 of the image forming apparatus 1 controls the image forming apparatus 1 as a whole. For example, the control unit 100 controls the operations of the above-described image forming section in order to form at least one of the toner image and the adhesive image on the sheet P through the electrophotographic process. In particular, with respect to operations for forming the adhesive image in the present embodiment, the control unit 100 performs control for preventing a drop in adhesive strength arising when powder adhesive is continuously supplied, over a given length, to the photosensitive member 101 at the same position in the width direction orthogonal to the conveyance direction of the sheet P. The control of operations for forming the adhesive image, performed by the control unit 100, will be described in detail later. The control unit 100 may include a processor for executing a computer program and memory storing the computer program. The memory of the control unit 100 may store data indicating one or more image formation patterns, which will be described later.

Figure 5A:
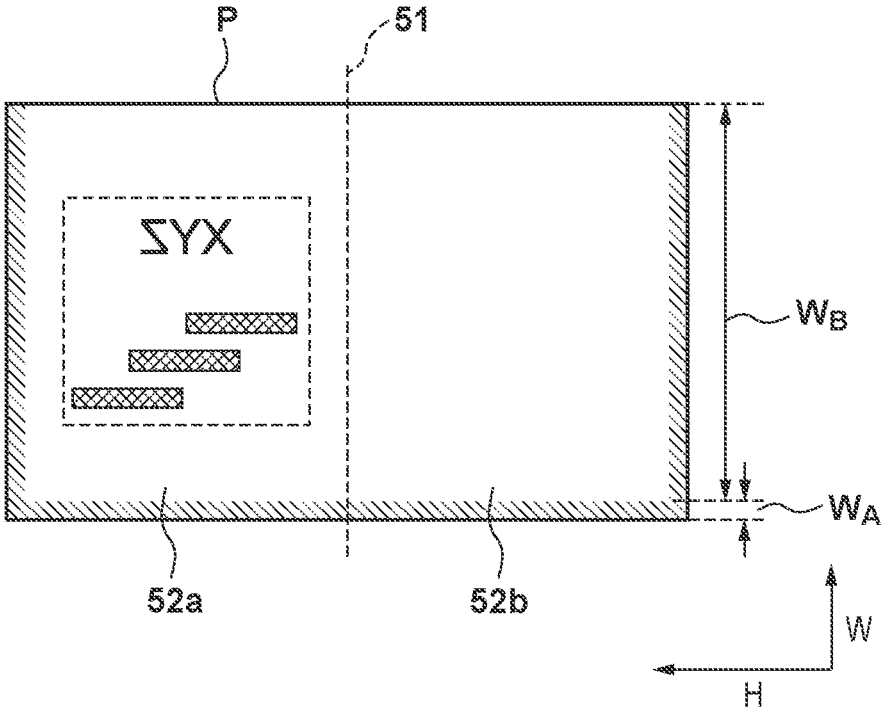
FIGS. 5A and 5B are diagrams illustrating examples of an adhering section and a non-adhering section pertaining to a given final product.
Figure 5B:
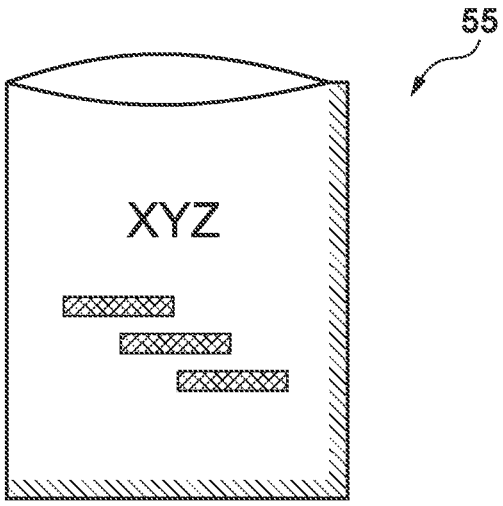

FIGS. 5A and 5B illustrate an example of a final product that can be generated by the image forming apparatus 1, and examples of an adhering section and a non-adhering section pertaining to the final product, respectively. In the example illustrated in FIG. 5A, the sheet P is constituted by two regions 52*a* and 52*b*, with a crease 51 serving as a boundary therebetween. A toner image, surrounded by the rectangular dotted line, is formed on the rear side of the region 52*a*. A U-shaped adhesive image, indicated by the diagonal line hatching, is formed across the two regions 52*a* and 52*b*. In a section $W_A$, which corresponds to a part of a width direction W orthogonal to a conveyance direction H, the powder adhesive adheres to the sheet P continuously along the conveyance direction. This section $W_A$ will be referred to as the "adhering section" in the following descriptions. In a section $W_B$, which corresponds to the remaining part in the width direction W, powder adhesive adheres to a leading edge part and a following edge part of the sheet P in the conveyance direction, but no powder adhesive adheres to the other parts. This section $W_B$ will be referred to as the "non-adhering section" in the following descriptions.

When the sheet P in FIG. 5A is folded in two at the crease 51 and the folded sheet P is heated and pressurized by the second fixing device 32, the opposing regions 52*a* and 52*b* are bonded together by the action of the powder adhesive which has melted. Then, in the example in FIG. 5A, by providing the non-adhering section $W_B$ in the width direction W, the sheet P becomes a bag-shaped final product 55 (contents can be stored in the part corresponding to the non-adhering section $W_B$). The final product 55 can be, for example, a medicine bag with the name of a medicine and other information printed thereon, for holding a medicine prescribed at a pharmacy. In this manner, the image forming apparatus 1 can be used to create the final product 55 simply and quickly by forming toner images and adhering using the powder adhesive in a non-stop manner (i.e., collectively in a single job).

The final product created using the image forming apparatus 1 is not limited to a medicine bag. For example, the final product may be a bag to hold any item such as accessories, souvenirs, tickets, or the like. The final product may also be a pressure-bonded document (e.g., a pressure-bonded postcard, a pay stub, or the like) with information that is to be kept confidential, such as personal information, printed inside. In the case of a pressure-bonded document, the powder adhesive can be caused to adhere to all four sides of the sheet P, unlike the example illustrated in FIG. 5A. Compared to bags which require a certain level of sealing strength, with a pressure-bonded document, where the user is intended to peel off the adhesive and open the document to check the information inside, the adhering amount of the powder adhesive Tn per unit of area may be adjusted to be lower.

Here, consider a case where the adhesive image is formed consecutively on at least one sheet P. In the adhering section $W_A$, which corresponds to part of the sheet P in the width direction W, it is necessary to cause the powder adhesive to adhere to the sheet P continuously along the conveyance direction in order to prevent the contents from spilling out when the final product is in use, prevent information to be kept confidential from being seen, and so on. However, if the powder adhesive is supplied to the photosensitive member 101 continuously without interruption from the same position in a rotation axis direction of the developing roller 105 (corresponding to the width direction W), it may not be possible for the supply of the powder adhesive from the supply roller 106 to the developing roller 105 to keep pace. As a result, is the required amount of powder adhesive does not adhere to the photosensitive member 101, the amount of powder adhesive transferred to the sheet P will decrease as well, which may cause defects such as the unintended separation of adhesive surfaces, the bottom coming out of the bag, parts which should adhere failing to do so when creating the final product, and so on.

Accordingly, in the present embodiment, the control unit 100 controls operations of the image forming section for forming the adhesive image such that different image formation patterns (called "formation patterns" hereinafter) for adhering sections are used at different times. For example, in a first conveyance period among periods in which at least one sheet P is conveyed, the control unit 100 sets the formation pattern of the adhesive image formed in the adhering section to a first pattern. Next, in a second conveyance period following the first conveyance period, the control unit 100 sets the formation pattern of the adhesive image formed in the adhering section to a second pattern different from the first pattern. At a given position in the adhering section, the photosensitive member 101 is exposed with laser light according to the first pattern, but in the second pattern, the photosensitive member 101 is not exposed with laser light at the same position. Focusing on a single position in the adhering section, this means that a blank period, in which no powder adhesive is supplied to the photosensitive member 101 from the developing roller 105 at that position, is provided. However, the control unit 100 continues to supply the powder adhesive from the holding part 104 to the supply roller 106 and the developing roller 105 throughout the first conveyance period and the second conveyance period. As a result, the powder adhesive carried by the developing roller 105 is replenished during the blank period, which prevents a situation in which there is an insufficient amount of powder adhesive to be caused to adhere to the sheet P at the required timing.

The adhering section may be extended compared to the example illustrated in FIG. 5A in order to use a plurality of different formation patterns in the adhering section while switching among the formation patterns over time. If the width of the entire adhering section is increased, a greater adhesive strength can be ensured, but if a bag is made from the sheet P, for example, the capacity of the bag will be reduced. How wide the adhering section should be depends on the requirements imposed on the final product to be created, and does not limit the technique according to the present disclosure. Several examples of the present embodiment pertaining to the relationship between the configuration of the adhering section and the conveyance periods, and the formation pattern used in each of the transfer periods, will be described further in the following sections.

First Example

In a first example, the adhering section $W_A$ is extended so as to include a first adhering section located at one end of the sheet in the width direction W, and a second adhering section located at the other end. To form the adhesive image in the adhering section $W_A$, the control unit 100 uses, in the image forming section, a formation pattern A1 in the first conveyance period, and a formation pattern A2 in the second conveyance period following the first conveyance period. Typically, the first conveyance period can be a period for forming an adhesive image on a first sheet P1, and the second conveyance period can be a period for forming an adhesive image on a second sheet P2 that follows the first sheet P1.

Figure 6C:
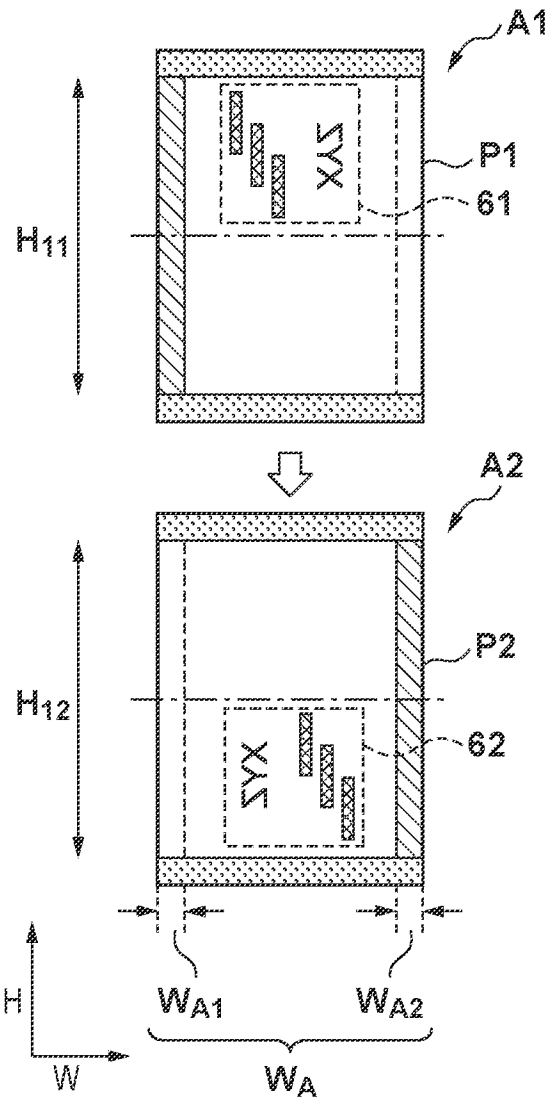
FIGS. 6A to 6C are diagrams illustrating examples of switching an image formation pattern over time according to an embodiment, in comparison with a comparative example.
Figure 6B:
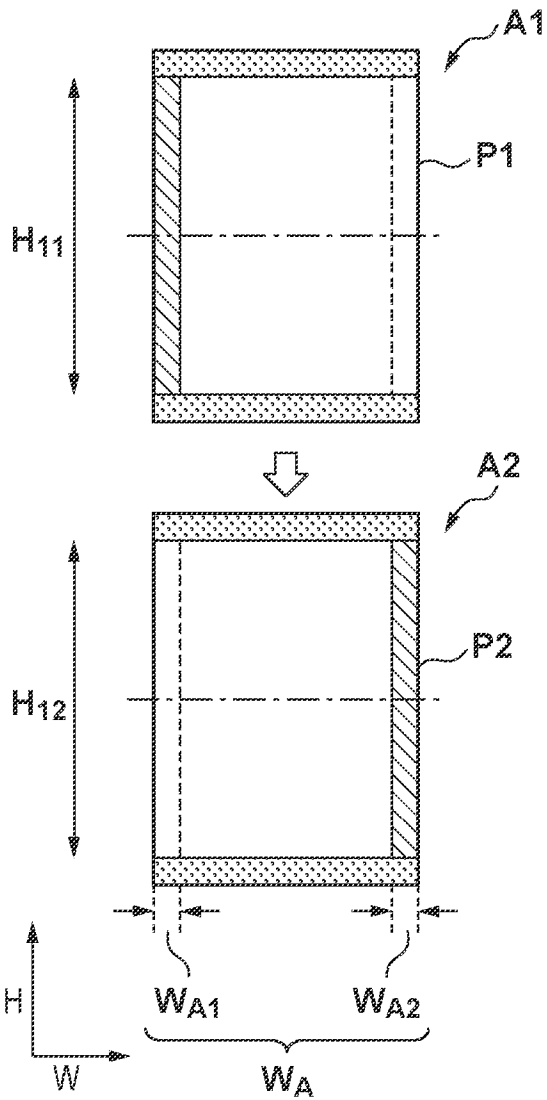
Figure 6A:
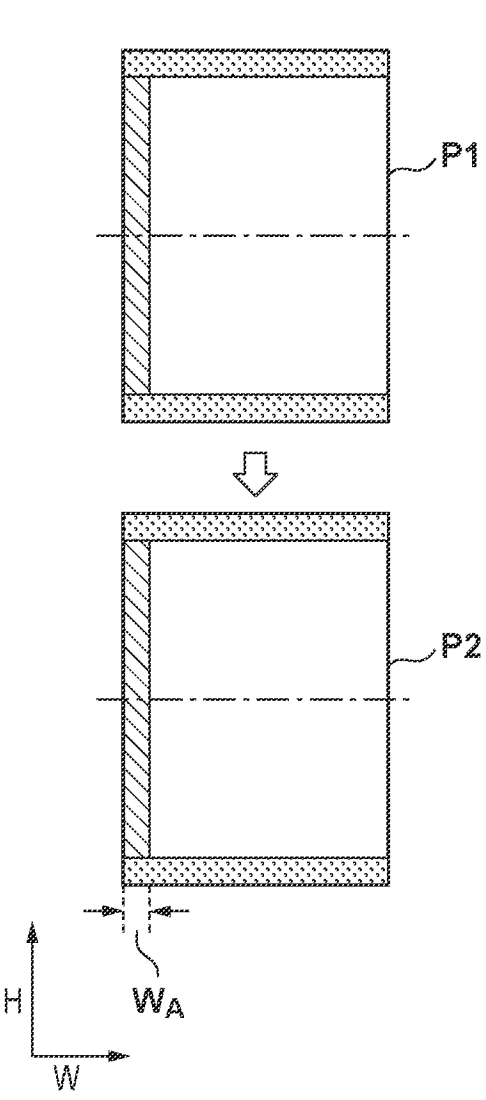

FIGS. 6A to 6C are diagrams illustrating examples of switching the formation pattern over time according to the first example, in comparison with a comparative example. FIG. 6A illustrates the comparative example. In the comparative example, the adhering section $W_A$ is not extended, and the powder adhesive is caused to adhere to the entire adhering section $W_A$ without interruption, over the first sheet P1 and the second sheet P2 following the first sheet P1. Here, the region on the sheet where the powder adhesive is caused to adhere is indicated by diagonal line hatching (and dots). This hatching can also be said to indicate the region where the photosensitive member 101 is exposed with laser light, i.e., the electrostatic latent image.

FIG. 6B illustrates an example in which the formation pattern is switched over time, according to the present example. Referring to FIG. 6B, the adhering section $W_A$ includes a first adhering section $W_{A1}$ and a second adhering section W. Here, the first adhering section $W_{A1}$ is located at a left end of the sheet, and the second adhering section $W_{A2}$ is located at a right end of the sheet. The formation pattern A1 is used in a first conveyance period $H_{11}$ for forming an adhesive image on the first sheet P1. The formation pattern A1 is a pattern which causes the powder adhesive to adhere to the sheet continuously along the conveyance direction H in the first adhering section $W_{A1}$, but does not cause the powder adhesive to adhere to the sheet in the second adhering section $W_{A2}$. On the other hand, the formation pattern A2 is used in a second conveyance period $H_{12}$ for forming an adhesive image on the subsequent second sheet P2. The formation pattern A2 is a pattern which causes the powder adhesive to adhere to the sheet continuously along the conveyance direction H in the second adhering section $W_{A2}$, but does not cause the powder adhesive to adhere to the sheet in the first adhering section $W_{A1}$. Although not illustrated here, when there is at least one additional sheet following the second sheet P2, two formation patterns can be applied in an alternating sequence to those sheets, i.e., formation patterns A1, A2, A1, A2, and so on. Switching the formation patterns over time in this manner makes it possible to provide the blank period, in which no powder adhesive is supplied to the photosensitive member 101, at all positions in the width direction W of the sheet, over a set period. In other words, for positions belonging to the second adhering section $W_{A2}$, the first conveyance period $H_{11}$ is the blank period, whereas for positions belonging to the first adhering section $W_{A1}$, the second conveyance period $H_{12}$ is the blank period. In the examples illustrated in FIGS. 6A to 6C, before and after each of the first conveyance period $H_{11}$ and the second conveyance period $H_{12}$, a short period (indicated by dots) is provided during which the powder adhesive adheres to the entirety of each sheet in the width direction W.

In the example in FIG. 6C, it is assumed to be necessary for the same toner image to be formed on each sheet. The formation patterns which are used are the same as the example in FIG. 6B, i.e., the formation pattern A1 is used for the first sheet P1 in the first conveyance period $H_{11}$, and the formation pattern A2 is used for the second sheet P2 in the second conveyance period $H_{12}$. Referring to FIG. 6C, a toner image 61 is formed in an upper region (on the rear side) of the first sheet P1. Here, for the second sheet P2 following the first sheet P1, the position where the powder adhesive adheres switches from the left side to the right side of the sheet. Accordingly, the control unit 100 controls the image forming section such that a rotated toner image 62, obtained by rotating the toner image 61 180 degrees, is formed in a lower region (on the rear side) of the second sheet P2. Then, along with such control, each sheet can be folded in two in order to create a plurality of bags having the same design in succession.

In the present example, the length of each of the first conveyance period $H_{11}$ and the second conveyance period $H_{12}$ is, for example, greater than or equal to a rotation period of the developing roller 105. In this case, the developing roller 105 is guaranteed to make at least one rotation in each blank period, which makes it possible to reliably replenish the powder adhesive from the supply roller 106 over the entire rotation direction of the developing roller 105.

Note that in the present example, each of the formation patterns A1 and A2 may be used continuously across two or more sheets as long as doing so will not result in an insufficient amount of powder adhesive being supplied. In other words, the sequence of formation patterns is not limited to the examples illustrated in FIGS. 6A to 6C, and a sequence such as patterns A1, A1, A2, A2, A1, A1, and so on may be employed for each sheet.

The inventors conducted an experiment to create 1,000 bags consecutively from 1,000 sheets, using the sequences of formation patterns according to the comparative example illustrated in FIG. 6A and the first example illustrated in FIG. 6B, respectively. For the experiment, the width of the adhering section $W_A$ in the comparative example, and the first adhering section $W_{A1}$ and the second adhering section $W_{A2}$ according to the first example, were set to approximately 5 mm. As a result of the experiment, in the comparative example, by the time the adhesive image was formed on the 100th sheet, the amount of powder adhesive supplied was insufficient, resulting in defects such as the bottom of the bag coming out or failing to adhere. On the other hand, the method according to the first example succeeded in creating 1,000 bags consecutively without any defects. Thus, according to the first example, the continuous supply of powder adhesive from the same position in the rotation axis direction of the developing roller 105 is suppressed, which avoids a situation in which the supply of powder adhesive is insufficient, and makes it possible to ensure the adhesive strength required for the final product. The width of each adhering section is not limited to the examples described above, as long as the required adhesive strength is ensured.

As can be understood from FIGS. 6A to 6C, the first example does not create dead space on the sheet, i.e., regions that are not used for the purpose of the final product (e.g., regions that do not contribute to the capacity of the bag) even though no powder adhesive adheres. The first example is therefore beneficial from the perspective of effectively using of the sheet as a material.

Second Example

In a second example, the adhering section $W_A$ is located at one end of the sheet in the width direction W, and is extended such that the sheet is divided into at least a first adhering section and a second adhering section in the width direction W. The control unit 100 causes the image forming section to use different formation patterns for the first conveyance period, and the second conveyance period that follows thereafter, in order to form the adhesive image in the adhering section $W_A$. In the second example as well, the first conveyance period can be a period for forming the adhesive image on the first sheet P1, and the second conveyance period can be a period for forming the adhesive image on the second sheet P2 that follows the first sheet P1.

Figure 7D:
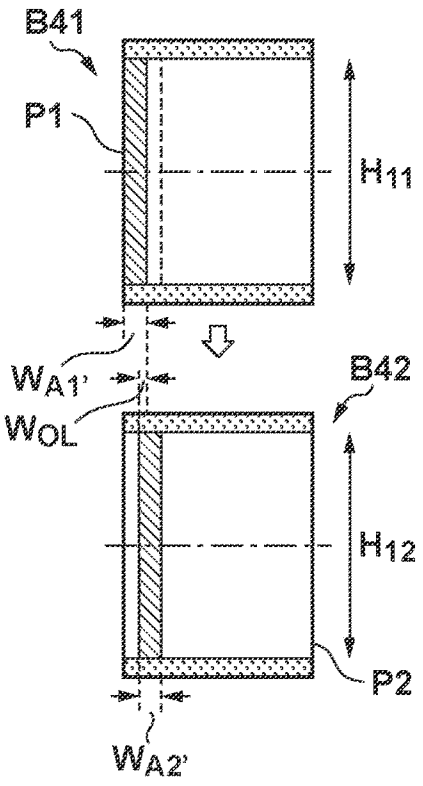
FIGS. 7A to 7D are diagrams illustrating examples of switching an image formation pattern over time according to an embodiment.
Figure 7C:
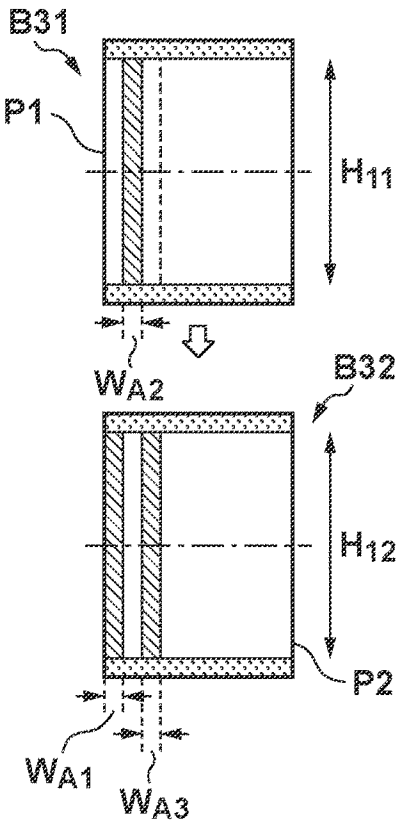
Figure 7B:
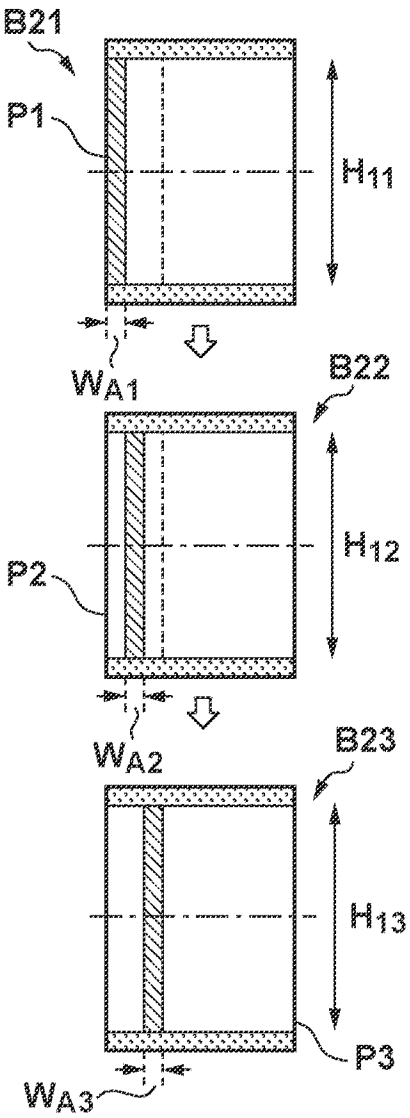
Figure 7A:
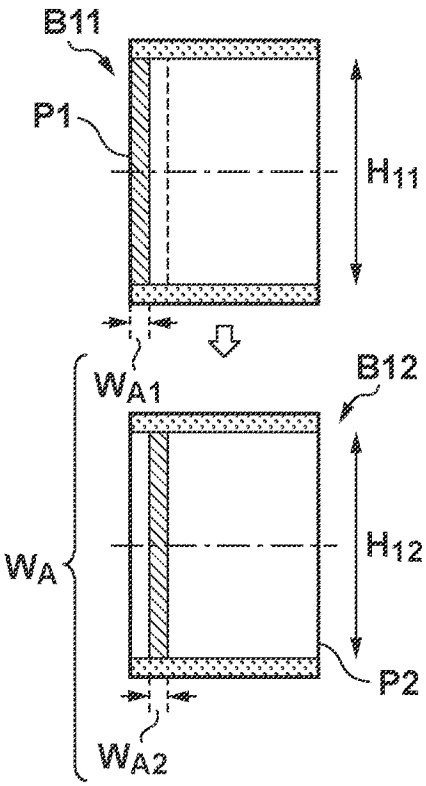

FIGS. 7A to 7D are diagrams illustrating examples of switching the formation pattern over time according to the second example. Referring to FIG. 7A, the adhering section $W_A$ is constituted by the first adhering section $W_{A1}$ and the second adhering section $W_{A2}$, which are adjacent to each other. Here, the adhering section $W_A$ is located at a left end of the sheet. A formation pattern B11 is used in the first conveyance period $H_{11}$ for forming an adhesive image on the first sheet P1. The formation pattern B11 is a pattern which causes the powder adhesive to adhere to the sheet continuously along the conveyance direction H in the first adhering section $W_{A1}$, but does not cause the powder adhesive to adhere to the sheet in the second adhering section $W_{A2}$. On the other hand, a formation pattern B12 is used in the second conveyance period $H_{12}$ for forming an adhesive image on the subsequent second sheet P2. The formation pattern B12 is a pattern which causes the powder adhesive to adhere to the sheet continuously along the conveyance direction H in the second adhering section $W_{A2}$, but does not cause the powder adhesive to adhere to the sheet in the first adhering section $W_{A1}$. Although not illustrated here, when there is at least one additional sheet following the second sheet P2, two formation patterns can be applied in an alternating sequence to those sheets, i.e., formation patterns B11, B12, B11, B12, and so on. Switching the formation patterns over time in this manner makes it possible to provide the blank period, in which no powder adhesive is supplied to the photosensitive member 101, at all positions in the width direction W of the sheet, over a set period. In other words, for positions belonging to the second adhering section $W_{A2}$, the first conveyance period $H_{11}$ is the blank period, whereas for positions belonging to the first adhering section $W_{A1}$, the second conveyance period $H_{12}$ is the blank period. In the examples illustrated in FIGS. 7A to 7D as well, before and after each of the first conveyance period $H_{11}$ and the second conveyance period $H_{12}$, a short period (indicated by dots) is provided during which the powder adhesive adheres to the entirety of each sheet in the width direction W.

In the example in FIG. 7B, the adhering section $W_A$ is constituted by the first adhering section $W_{A1}$, the second adhering section $W_{A2}$, and a third adhering section $W_{A3}$, which are adjacent to each other. Here, the adhering section $W_A$ is located at a left end of the sheet. A formation pattern B21 is used in the first conveyance period $H_{11}$ for forming an adhesive image on the first sheet P1. The formation pattern B21 is a pattern which causes the powder adhesive to adhere to the sheet continuously along the conveyance direction H in the first adhering section $W_{A1}$, but does not cause the powder adhesive to adhere to the sheet in the second adhering section $W_{A2}$ and the third adhering section $W_{A3}$. A formation pattern B22 is used in the second conveyance period $H_{12}$ for forming an adhesive image on the subsequent second sheet P2. The formation pattern B22 is a pattern which causes the powder adhesive to adhere to the sheet continuously along the conveyance direction H in the second adhering section $W_{A2}$, but does not cause the powder adhesive to adhere to the sheet in the first adhering section $W_{A1}$ and the third adhering section $W_{A3}$. A formation pattern B23 is used in a third conveyance period $H_{13}$ for forming an adhesive image on a third sheet P3 following thereafter. The formation pattern B23 is a pattern which causes the powder adhesive to adhere to the sheet continuously along the conveyance direction H in the third adhering section $W_{A3}$, but does not cause the powder adhesive to adhere to the sheet in the first adhering section $W_{A1}$ and the second adhering section $W_{A2}$. Although not illustrated here, when there is at least one additional sheet following the third sheet P3, three formation patterns can be applied repeatedly to those sheets, i.e., formation patterns B21, B22, B23, B21, B22, B23, and so on. Switching the formation patterns over time in this manner makes it possible to provide the blank period at all positions in the width direction W of the sheet, over a set period.

In the example in FIG. 7C as well, the adhering section $W_A$ is constituted by the first adhering section $W_{A1}$, the second adhering section $W_{A2}$, and the third adhering section $W_{A3}$, which are adjacent to each other. However, a formation pattern B31 is used in the first conveyance period $H_{11}$ for forming an adhesive image on the first sheet P1. The formation pattern B31 is a pattern which causes the powder adhesive to adhere to the sheet continuously along the conveyance direction H in the second adhering section $W_{A2}$, but does not cause the powder adhesive to adhere to the sheet in the first adhering section $W_{A1}$ and the third adhering section $W_{A3}$. A formation pattern B32 is used in the second conveyance period $H_{12}$ for forming an adhesive image on the subsequent second sheet P2. The formation pattern B32 is a pattern which causes the powder adhesive to adhere to the sheet continuously along the conveyance direction H in the first adhering section $W_{A1}$ and the third adhering section $W_{A3}$, but does not cause the powder adhesive to adhere to the sheet in the second adhering section W. Switching the formation patterns over time in this manner makes it possible to provide the blank period at all positions in the width direction W of the sheet, over a set period. The formation pattern B32 in FIG. 7C is a pattern that forms band-shaped regions where the powder adhesive is to be adhered on the sheet as a plurality of stripes, but the number of bands is not limited to two, and may be three or more, for example.

In the example in FIG. 7D, the adhering section $W_A$ is constituted by a first adhering section $W_{A1'}$ and a second adhering section $W_{A2'}$ which overlap slightly. A formation pattern B41 is used in the first conveyance period $H_{11}$ for forming an adhesive image on the first sheet P1. The formation pattern B41 is a pattern which causes the powder adhesive to adhere to the sheet continuously along the conveyance direction H in the first adhering section $W_{A1'}$, but does not cause the powder adhesive to adhere to the sheet in the remaining sections. A formation pattern B42 is used in the second conveyance period $H_{12}$ for forming an adhesive image on the second sheet P2. The formation pattern B42 is a pattern which causes the powder adhesive to adhere to the sheet continuously along the conveyance direction H in the second adhering section $W_{A2'}$, but does not cause the powder adhesive to adhere to the sheet in the remaining sections. In the example in FIG. 7D, there will be no blank period for a section $W_{OL}$ in which the first adhering section $W_{A1'}$ and the second adhering section $W_{A2'}$ slightly overlap. However, if the overlapping section $W_{OL}$ is sufficiently narrow, the amount of powder adhesive that is supplied will not be insufficient, and this adhering section configuration may therefore be employed. For example, the inventors confirmed that when each of the first adhering section $W_{A1'}$ and second adhering section $W_{A2'}$ is 6 mm wide and the overlapping section $W_{OL}$ is 1 mm wide, no defects caused by the supply of powder adhesive being insufficient will occur, and the required adhesive strength can be ensured.

Of course, the adhering section $W_A$ is not limited to the example illustrated here, and may instead be located on the right end of the sheet.

In all the examples illustrated in FIGS. 7A to 7D, a toner image may be formed on each sheet in addition to the adhesive image. In these examples, the position in the width direction where the powder adhesive adheres is not inverted horizontally for each sheet, and the toner image therefore need not be rotated for each sheet.

In the present example too, the length of each conveyance period is, for example, greater than or equal to the rotation period of the developing roller 105. In this case, the developing roller 105 is guaranteed to make at least one rotation in each blank period, which makes it possible to reliably replenish the powder adhesive from the supply roller 106 over the entire rotation direction of the developing roller 105. However, in the example in FIG. 7B, the above-described effect of reliably replenishing the powder adhesive can be achieved as long as the total length of the two conveyance periods is greater than or equal to the rotation period of the developing roller 105. Additionally, the same formation pattern may be used continuously across two or more sheets as long as doing so will not result in an insufficient amount of powder adhesive being supplied.

The inventors conducted an experiment to create 1,000 bags consecutively from 1,000 sheets, using the sequences of formation patterns according to the second example illustrated in FIG. 7A, in the same manner as the experiment described above in the first example. Here too, the width of each of the first adhering section $W_{A1}$ and the second adhering section $W_{A2}$ were set to approximately 5 mm. As a result of the experiment, the method according to the second example also succeeded in creating 1,000 bags consecutively without any defects such as the bottom of the bag coming out or failure to adhere. Thus, according to the second example as well, the continuous supply of powder adhesive from the same position in the rotation axis direction of the developing roller 105 is suppressed, which avoids a situation in which the supply of powder adhesive is insufficient, and makes it possible to ensure the adhesive strength required for the final product. Here, too, the width of each adhering section is not limited to the examples described above, as long as the required adhesive strength is ensured.

Compared to the first example described in the previous section, in the second example, the position in the width direction where the powder adhesive adheres is not inverted horizontally for each sheet. This means that when a plurality of final products are created consecutively from a plurality of sheets, the orientation of the final products will remain constant. As such, the final products will be in the same orientation when the user removes the final products from the discharge unit 35 at the end of the job. The second example therefore has an advantage over the first example in that the workload of the user can be reduced. Additionally, in the second example, it is not necessary to rotate the toner image for each sheet when the same toner image is required to be formed on a plurality of sheets, which makes it possible to avoid complicating the implementation of the image forming process.

Additionally, in the first example and the second example, focusing on a single sheet, the section, in the width direction W, where the powder adhesive actually adheres to the sheet (i.e., where the photosensitive member 101 is exposed with laser light) is constant regardless of the position in the conveyance direction. As such, the control unit 100 can specify the appropriate formation pattern to the image forming section simply by determining whether or not each of pixel positions in the width direction W belongs to the above-described sections, without storing a two-dimensional pattern of the adhesive image in advance. In this manner, the present example provides an advantage in that a large amount of memory resources are not used to store formation patterns. This applies to the first example described above as well.

Note that in the examples of FIGS. 5A and 5B, the final product 55, which is a bag, is created by causing the powder adhesive to adhere to one side parallel to the conveyance direction H and two sides parallel to the width direction W, and then folding the sheet at the crease 51 located in the center in the conveyance direction. The side where the adhering section $W_A$ is located becomes the bottom part of the bag, and the opposite side (the top, in the drawings) becomes the opening of the bag. As another example, a bag in which the crease 51 is the bottom part of the bag can be created by applying the powder adhesive only to the two sides parallel to the conveyance direction H and then folding the sheet at the crease 51. In this case, the adhering section $W_A$ is provided at both ends in the width direction W, and the method of the present example may be applied to each of the two adhering sections $W_A$. This also applies to a third example and a fourth example described hereinafter.

Third Example

In a third example as well, the adhering section $W_A$ is located at one end of the sheet in the width direction W, and is extended such that the sheet is divided into at least a first adhering section and a second adhering section in the width direction W. The control unit 100 causes the image forming section to use different formation patterns for the first conveyance period, and the second conveyance period that follows thereafter, in order to form the adhesive image in the adhering section $W_A$. However, in the third example, both the first conveyance period and the second conveyance period are included in a period for forming the adhesive image on a single sheet.

Figure 8A:
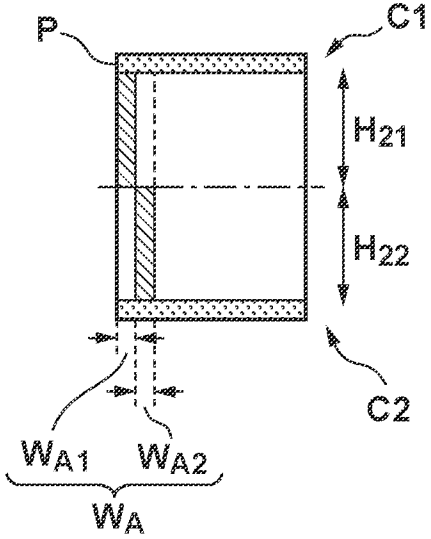
FIGS. 8A to 8E are diagrams illustrating examples of switching an image formation pattern over time according to an embodiment.
Figure 8B:
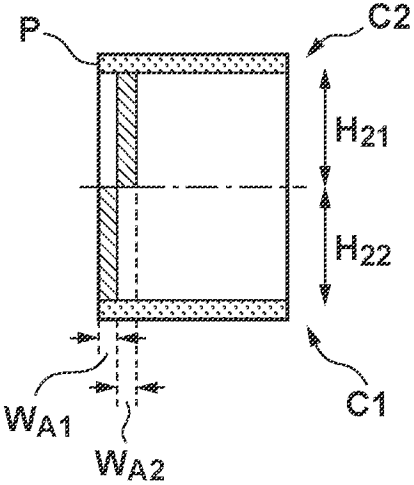

FIGS. 8A to 8E are diagrams illustrating examples of switching the formation pattern over time according to the third example. Referring to FIG. 8A, the adhering section $W_A$ is constituted by the first adhering section $W_{A1}$ and the second adhering section $W_{A2}$, which are adjacent to each other. Here, the adhering section $W_A$ is located at a left end of the sheet. A formation pattern C1 is used in a first conveyance period $H_{21}$, which corresponds to the first half of a period for forming an adhesive image on the sheet P. The formation pattern C1 is a pattern which causes the powder adhesive to adhere to the sheet continuously along the conveyance direction H in the first adhering section $W_{A1}$, but does not cause the powder adhesive to adhere to the sheet in the second adhering section $W_{A2}$. On the other hand, a formation pattern C2 is used in a second conveyance period $H_{22}$, which corresponds to the second half of the period for forming an adhesive image on the sheet P. The formation pattern C2 is a pattern which causes the powder adhesive to adhere to the sheet continuously along the conveyance direction H in the second adhering section $W_{A2}$, but does not cause the powder adhesive to adhere to the sheet in the first adhering section $W_{A1}$. Switching the formation patterns over time in this manner makes it possible to provide the blank period, in which no powder adhesive is supplied to the photosensitive member 101, at all positions in the width direction W of the sheet, over a set period. In the example illustrated in FIG. 8A, before the first conveyance period $H_{21}$ and after the second conveyance period $H_{22}$, a short period (indicated by dots) is provided during which the powder adhesive adheres to the entirety of each sheet in the width direction W. The example in FIG. 8B differs from the example in FIG. 8A in that the formation pattern C2 is used in the first conveyance period $H_{21}$ and the formation pattern C1 is used in the second conveyance period $H_{22}$.

Figure 8C:
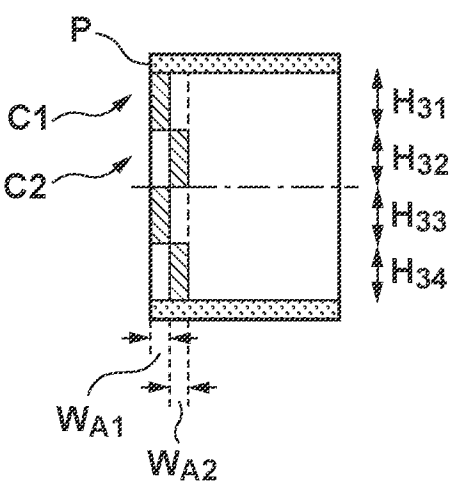
Figure 8D:
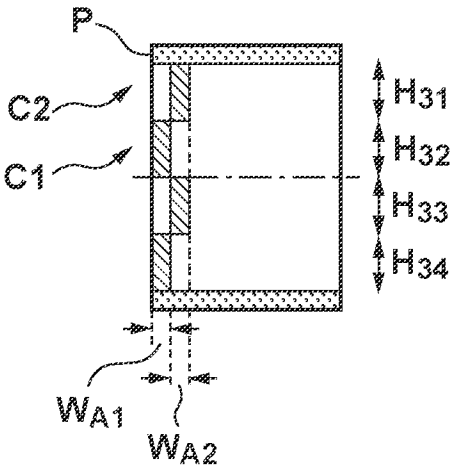

In the example in FIG. 8C as well, the adhering section $W_A$ is constituted by the first adhering section $W_{A1}$ and the second adhering section $W_{A2}$, which are adjacent to each other. Here, the period for forming the adhesive image on the sheet P is divided into four conveyance periods $H_{31}$, $H_{32}$, $H_{33}$, and $H_{34}$. The formation pattern C1 is used in the first conveyance period $H_{31}$. The formation pattern C2 is used in the second conveyance period $H_{32}$. The formation pattern C1 is used again in the third conveyance period $H_{33}$. The formation pattern C2 is used again in the fourth conveyance period $H_{34}$. In the example in FIG. 8C, the length of a single blank period is approximately ¼ the length of the sheet P in the conveyance direction. For example, if the length L of the sheet P in the conveyance direction is equal to 297 mm, which is the length of the A4 size in the longer direction, then ¼ of the length L is approximately 74 mm. In this case, for example, as long as the circumference of the developing roller 105 is less than or equal to 74 mm, the developing roller 105 can make at least one rotation in each blank period, making it possible to reliably replenish the powder adhesive over the entire developing roller 105 in the rotation direction. The example in FIG. 8D differs from the example in FIG. 8C in that the formation pattern C2 is used in the first conveyance period $H_{31}$ and the third conveyance period $H_{33}$, and the formation pattern C1 is used in the second conveyance period $H_{32}$ and the fourth conveyance period $H_{34}$.

Figure 8E:
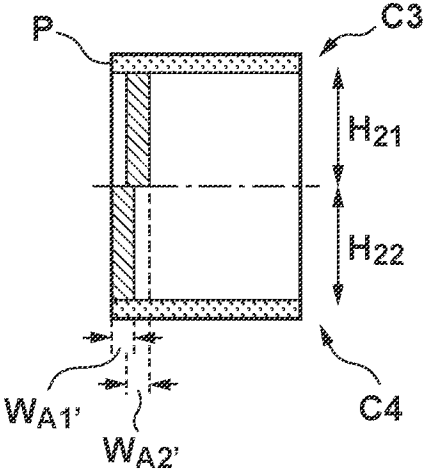

In the example in FIG. 8E, the adhering section $W_A$ is constituted by a first adhering section $W_{A1'}$ and a second adhering section $W_{A2'}$ which overlap slightly. As described with reference to FIG. 7D, even if there is no blank period for this section which overlaps slightly, if the overlapping section is sufficiently narrow, the amount of powder adhesive that is supplied will not be insufficient, and this adhering section configuration may therefore be employed.

Of course, the adhering section $W_A$ is not limited to the example illustrated here, and may instead be located on the right end of the sheet. Additionally, a toner image may be formed on each sheet in addition to the adhesive image.

In the third example too, the position where the powder adhesive adheres in the width direction is not inverted for each sheet, and thus the orientation of the final products created from a plurality of sheets is already aligned at the end of the job. Therefore, like the second example, the third example has an advantage in that the workload of the user can be reduced. It is also not necessary to rotate the toner image for each sheet, which makes it possible to avoid complicating the implementation of the image forming process. Additionally, in the third example, it is not necessary to switch the adhesive image formed on a single sheet for each sheet. As such, if an appropriate pattern for the adhesive image for a single sheet is defined in advance, the control unit 100 can use that same pattern for a plurality of sheets. In this manner, the third example provides an advantage in that the control of the image forming section can be further simplified.

Fourth Example

In the first to third examples, in each conveyance period, a formation pattern that is one-dimensional in the width direction (e.g., an exposure pattern of the photosensitive member 101 for each of lines following the width direction) is constant. In contrast, in the fourth example described in this section, the formation pattern that is one-dimensional in the width direction can displace linearly or non-linearly as the sheet is conveyed. When the period for forming an adhesive image on a single sheet is divided into two or more conveyance periods and viewed, the formation pattern within the adhering section in a given conveyance period will differ from the formation pattern within the adhering section in another conveyance period.

Figure 9A:
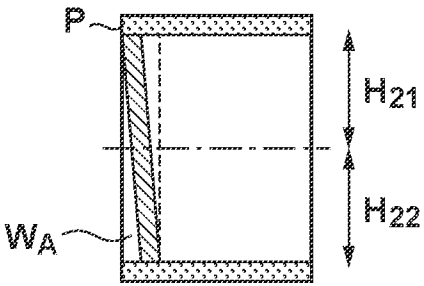
FIGS. 9A to 9I are diagrams illustrating examples of an image formation pattern according to an embodiment.
Figure 9B:
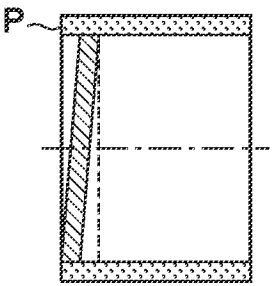
Figure 9C:
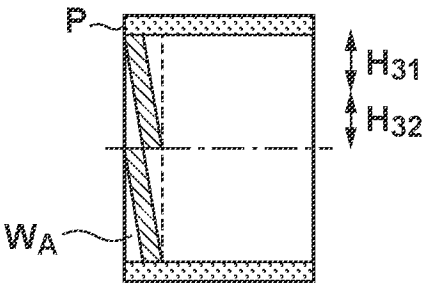
Figure 9D:
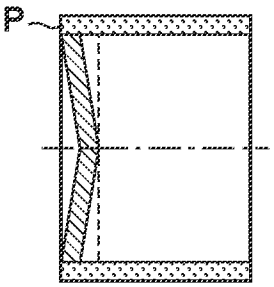
Figure 9E:
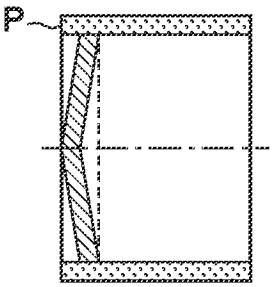
Figure 9F:
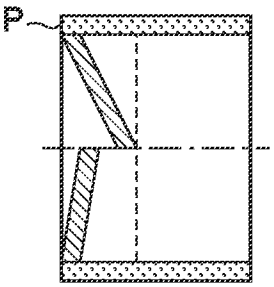
Figure 9G:
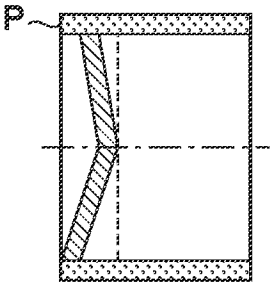
Figure 9H:
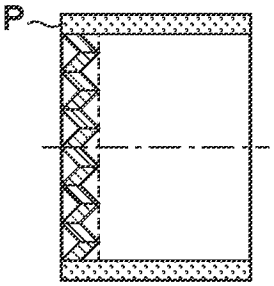
Figure 9I:
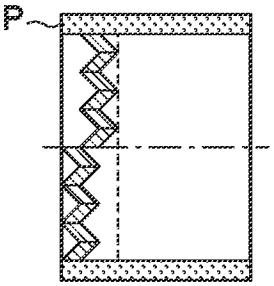

FIGS. 9A to 9I and 10A to 10H illustrate a variety of examples of the formation pattern according to the fourth example. Referring to FIG. 9A, the adhering section $W_A$ is located at a left end of the sheet. The width of the section where the powder adhesive actually adheres to the sheet (called an "adhering section" hereinafter) is equal to half the width of the adhering section $W_A$. The adhering section displaces linearly in the width direction within the adhering section $W_A$ as the sheet is conveyed, forming a two-dimensional pattern of slanted bands. In the example in FIG. 9A, the formation pattern in the first conveyance period $H_{21}$ is different from the formation pattern in the second conveyance period $H_{22}$. In this manner, a blank period in which the powder adhesive is not supplied to the photosensitive member 101 is produced at each of positions in the width direction W of the sheet. FIG. 9B illustrates an example in which the same formation pattern as the pattern in FIG. 9A is inverted horizontally within the adhering section $W_A$. In the example in FIG. 9C, the adhering section repeats the linear displacement in the width direction twice within the adhering section $W_A$ as the sheet is conveyed. In the example in FIG. 9C, the formation pattern in the first conveyance period $H_{31}$ is different from the formation pattern in the second conveyance period $H_{32}$. In the examples in FIGS. 9D to 9I as well, the adhering section displaces in the width direction within a wider adhering section as the sheet is conveyed, resulting in the formation pattern in a given conveyance period being different from the formation pattern in another conveyance period.

Figure 10A:
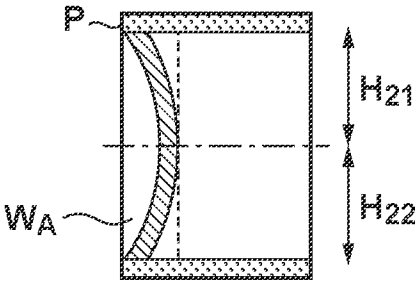
FIGS. 10A to 10H are diagrams illustrating further examples of an image formation pattern according to an embodiment.
Figure 10B:
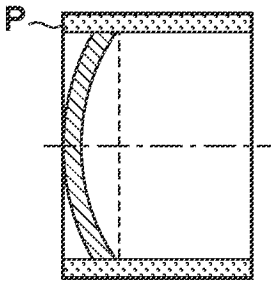
Figure 10C:
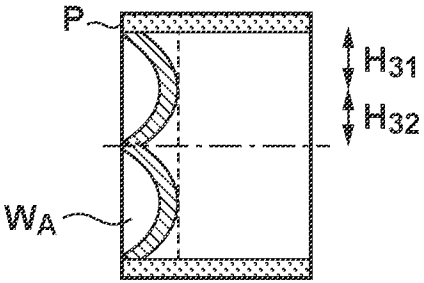
Figure 10D:
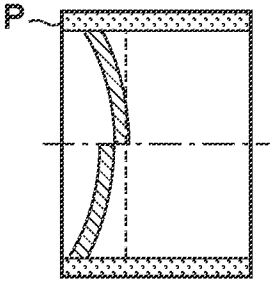
Figure 10E:
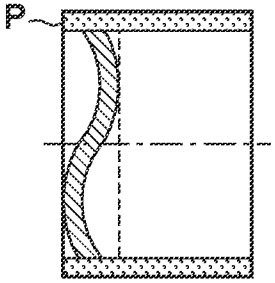
Figure 10F:
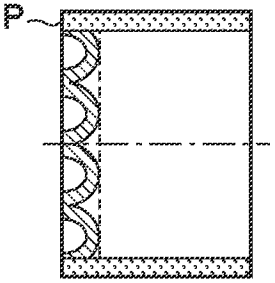
Figure 10G:
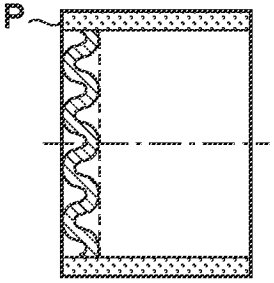
Figure 10H:
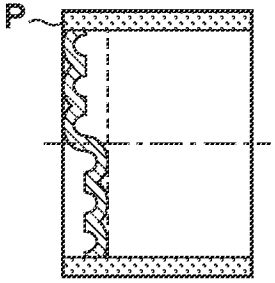

Referring to FIG. 10A, the adhering section $W_A$ is located at a left end of the sheet. The adhering section displaces non-linearly in the width direction within the adhering section $W_A$ as the sheet is conveyed, forming an arc-shaped two-dimensional pattern. In the example in FIG. 10A, the formation pattern in the first conveyance period $H_{21}$ is different from the formation pattern in the second conveyance period $H_{22}$. In this manner, a blank period in which the powder adhesive is not supplied to the photosensitive member 101 is produced at each of positions in the width direction W of the sheet. FIG. 10B illustrates an example in which the same arc-shaped formation pattern as the pattern in FIG. 10A is inverted horizontally within the adhering section $W_A$. In the example in FIG. 10C, the adhering section repeats the non-linear displacement in the width direction twice within the adhering section $W_A$ along the time axis. In the example in FIG. 10C, the formation pattern in the first conveyance period $H_{31}$ is different from the formation pattern in the second conveyance period $H_{32}$. In the examples in FIGS. 10D to 10H as well, the adhering section displaces in the width direction within a wider adhering section as the sheet is conveyed, resulting in the formation pattern in a given conveyance period being different from the formation pattern in another conveyance period.

Of course, the adhering section $W_A$ is not limited to the example illustrated here, and may instead be located on the right end of the sheet. Additionally, a toner image may be formed on each sheet in addition to the adhesive image.

In the fourth example too, the position where the powder adhesive adheres in the width direction is not inverted for each sheet, and thus the orientation of the final products created from a plurality of sheets is already aligned at the end of the job. Therefore, like the second example and the third example, the fourth example has an advantage in that the workload of the user can be reduced. It is also not necessary to rotate the toner image for each sheet, which makes it possible to avoid complicating the implementation of the image forming process. Additionally, like the third example, the fourth example provides an advantage in that because there is no need to switch the adhesive image formed on a single sheet for each sheet, the control of the image forming section can be simplified even more.

Although many examples pertaining to the relationship between the configuration of the adhering section and the conveyance period, and the formation patterns used in each of the conveyance periods, have been described thus far with reference to FIGS. 6A to 10H, these examples may be combined with each other in any way. For example, any two or more of the adhesive images illustrated in FIGS. 8A to 10H may be used in a manner in which the adhesive images are switched for each sheet as in the second example. Additionally, although each drawing illustrates an example in which the adhesive image is a binary image, the adhesive image may be a multivalue image having gradations. For example, in a region of the above-described formation pattern where no powder adhesive is caused to adhere to the sheet, a thin amount of the powder adhesive may actually be caused to adhere to the sheet.

Additionally, the adhesive image formed on a single sheet does not necessarily have to be linearly- or rotationally-symmetrical. However, if a line-symmetrical adhesive image is formed with the crease at the center, the adhesive will adhere to both opposing regions of the folded sheet, and a stronger adhesive strength can be obtained. An adhesive image which is symmetrical relative to the crease may be beneficial if strong adhesion is desirable in terms of the application of the final product.

Second Embodiment

Figure 11A:
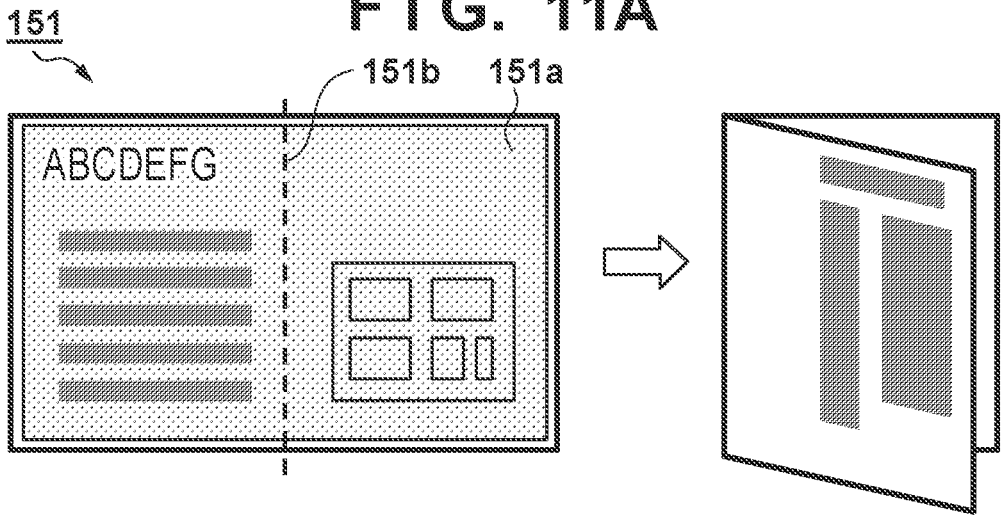
FIGS. 11A to 11C are diagrams illustrating a final product, and an adhesive region, according to an embodiment.
Figure 11B:
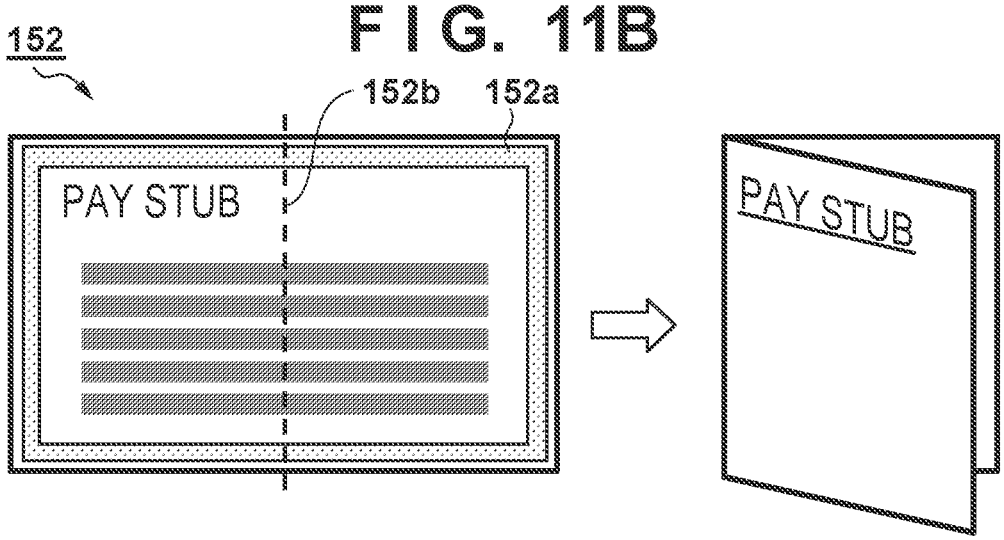
Figure 11C:
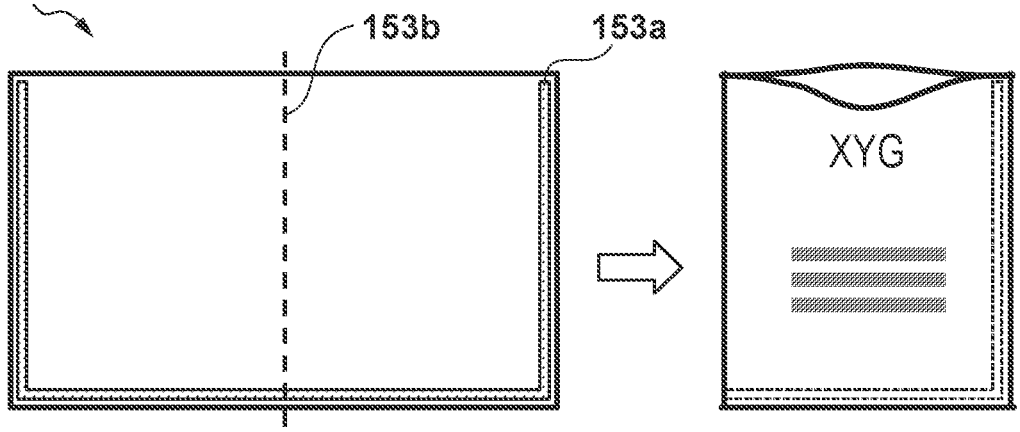

A second embodiment will be described, focusing on the differences from the first embodiment. FIGS. 11A to 11C illustrate examples of final products produced by the image forming apparatus 1, and adhesive regions for producing each of the final products. Note that the "adhesive region" is a region, on the sheet P, to which the powder adhesive Tn adheres. FIG. 11A illustrates a case where the final product is a pressure-bonded postcard 151. In this case, approximately the entire region of one side of the sheet P serves as an adhesive region 151*a*, and the sheet P is pressure-bonded having been folded at a crease 151*b* located in the center. FIG. 11B illustrates a case where the final product is a pay stub 152. In this case, approximately the entire outer peripheral area of one side of the sheet P serves as an adhesive region 152*a*, and the sheet P is pressure-bonded having been folded at a crease 152*b* located in the center. FIG. 11C illustrates a case where the final product is a medicine bag 153. In this case, three sides except one of the outer peripheral area of one side of the sheet P serve as an adhesive region 153*a*. The powder adhesive Tn is caused to adhere such that two parallel sides among the three sides are parallel to a crease 153*b*. Folding the sheet P at the crease 153*b* and pressure-bonding the sheet P forms the sheet P into a bag shape.

For final products such as the pressure-bonded postcard 151 and the pay stub 152 illustrated in FIGS. 11A and 11B, where the content printed on the inside of the fold (the adhesive surface side) is to be checked by a specific person, the adhesive strength, i.e., the amount of powder adhesive Tn caused to adhere, is adjusted so that the adhesive surface can be peeled away. On the other hand, for a final product such as the medicine bag 153 illustrated in FIG. 11C, which require that the adhesive surface be maintained, the adhesive strength, i.e., the amount of powder adhesive Tn caused to adhere, is adjusted so that the adhesive surface does not peel away.

Figure 12:
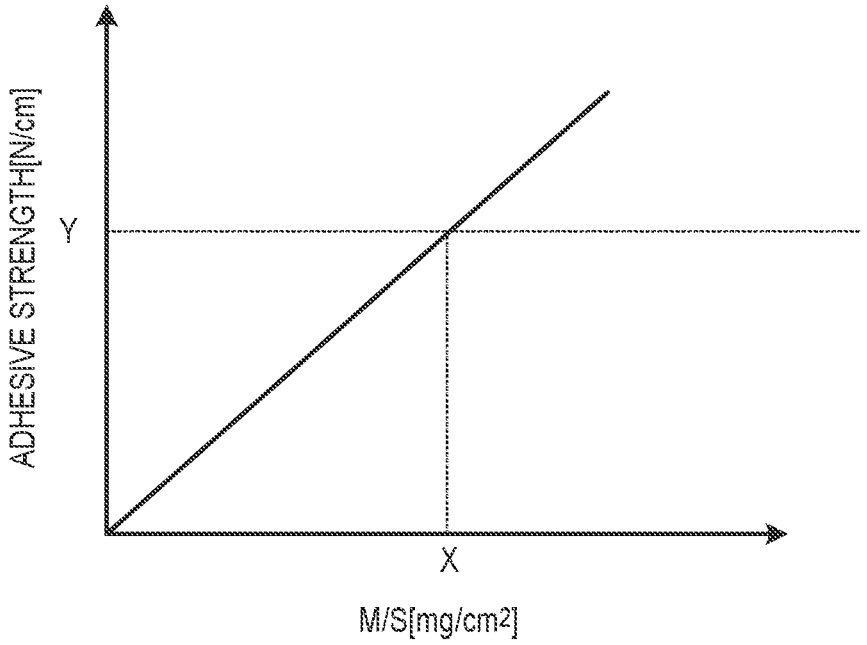
FIG. 12 is a diagram illustrating a relationship between an adhering amount of powder adhesive per unit of area and adhesive strength.

FIG. 12 illustrates a relationship between the weight per unit of area (represented by M/S hereinafter) and the adhesive strength of the powder adhesive Tn. As illustrated in FIG. 12, as M/S increases, so too does the adhesive strength. Note that Yin FIG. 12 corresponds to the strength of the sheet P, and to be more specific, corresponds to a force that begins to produce damage such as tears in the sheet P when a force in the direction in which the adhesive surface is peeled away acts on the sheet P. Based on FIG. 12, when M/S is greater than X, the adhesive strength is greater than the strength of the sheet P. Thus for example, when M/S is set to be lower than X, the adhesive surface can be peeled away. As such, M/S may be set to less than X for a final product in which the adhesive surface is to be peeled away, such as the pressure-bonded postcard 151 and the pay stub 152 illustrated in FIGS. 11A and 11B, respectively. M/S may be set to X or higher for a final product in which the adhesive surface is to be maintained, such as the medicine bag 153 illustrated in FIG. 11C.

Consider, for example, a case where powder images are formed consecutively on a plurality of sheets P through a single print job. When powder images are formed consecutively on a plurality of sheets P, a predetermined standard interval R is provided between a following edge of the preceding sheet and a leading edge of the following sheet (see FIG. 13A). Note that the standard interval R is set to be as short as possible in order to improve productivity. Additionally, a sheet P on which a first type of powder image is formed (using the powder adhesive Tn) and a sheet P on which a second type of powder image is formed (not using the powder adhesive Tn) can be intermixed in a single print job.

Figure 13A:
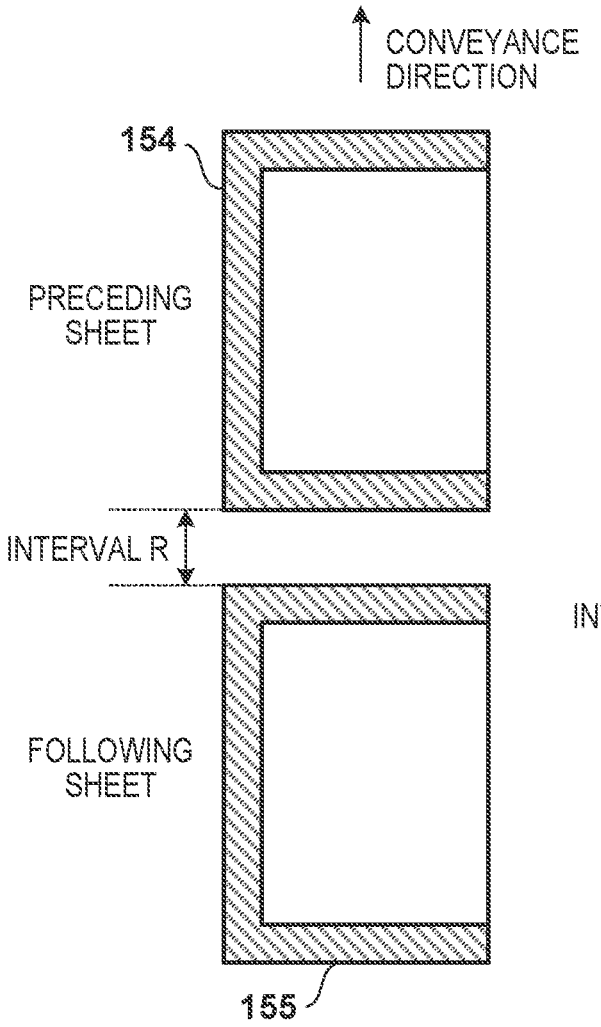
FIGS. 13A and 13B are descriptive diagrams illustrating sheet interval control according to an embodiment.

Here, consider a case where the first type of powder image is formed consecutively on the sheets P. FIG. 13A illustrates a case where the medicine bag 153 illustrated in FIG. 11C is formed consecutively. Note that a hatched region 154 in FIG. 13A (and in FIG. 13B) is the adhesive region of the preceding sheet, and a hatched region 155 is the adhesive region of the following sheet. In FIG. 13A, it is necessary to cause the powder adhesive Tn to continuously adhere to the left side of the sheet P parallel to the conveyance direction. This means that the powder adhesive Tn is continuously supplied to the photosensitive member 101 from the same position in the direction of the rotation axis of the developing roller 105 (which corresponds to the width direction orthogonal to the conveyance direction). Such being the case, the supply of the powder adhesive Tn from the supply roller 106 to the developing roller 105 cannot keep up, and the amount of the powder adhesive Tn caused to adhere to the sheets P will decrease. As a result, the required amount of the powder adhesive Tn does not adhere to the adhesive region, resulting in a defect in the final product (called a "final product defect" hereinafter), such as the adhesive surface peeling away, the part which is required to adhere not adhering, and so on.

Figure 13B:
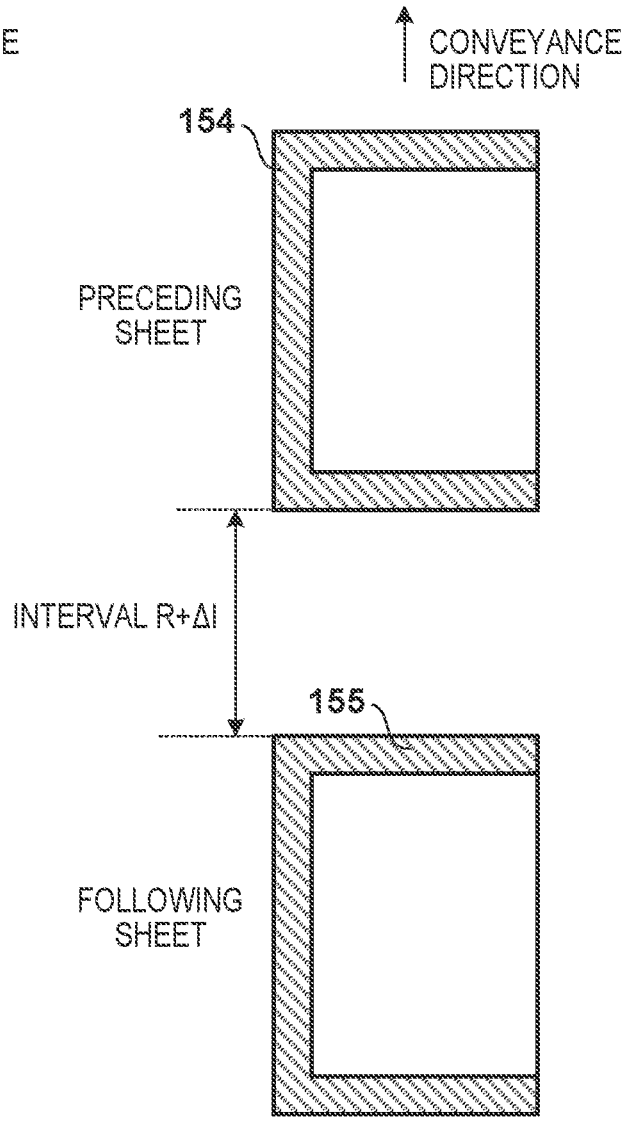

Thus in the present embodiment, when, as illustrated in FIG. 13B, both the preceding sheet and the following sheet are sheets P on which the first type of powder image is formed, the control unit 100 widens a sheet interval between the preceding sheet and the following sheet by ΔI beyond the standard interval R. Note that if at least one of the preceding sheet and the following sheet is a sheet P on which the second type of powder image is formed, the control unit 100 controls the sheet interval between the preceding sheet and the following sheet to be the standard interval R.

The increase amount ΔI in the sheet interval is determined on the basis of the time required for the supply of the powder adhesive Tn to the developing roller 105 to recover. For example, the increase amount ΔI can be set to the circumference of the developing roller 105 or a value greater than the circumference of the developing roller 105. By increasing the sheet interval at least by the circumference of the developing roller 105, the powder adhesive Tn is supplied from the supply roller 106 over one rotation of the developing roller 105. In light of the fact that the amount of powder adhesive Tn in the developing chamber 109 decreases, the increase amount ΔI can be set to a value greater than or equal to the circumference of the supply roller 106 or the distance (length) over which the sheet P is conveyed during the time required for the transport member 108 to make one revolution. For example, the increase amount ΔI can be set to the highest value of the circumference of the developing roller 105, the circumference of the supply roller 106, and the distance (length) over which the sheet P is conveyed during the time required for the transport member 108 to make one revolution, or to a value greater than the stated highest value.

FIG. 14A illustrates a result of a case where four of the medicine bags 153 illustrated in FIG. 11C are formed consecutively. Note that in FIG. 14A, the increase amount ΔI is indicated as a multiple of the circumference of the developing roller 105. As illustrated in FIG. 14A, in an environment in which the temperature and humidity are 23° C. and 50%, respectively, when ΔI is 3, 5, and 8, no final product defects arise in the four medicine bags 153 when using a new process cartridge 7*n*. As a comparative example, in an environment in which the temperature and humidity are 23° C. and 50% respectively, when ΔI is 0, a final product defect arises in the final (the fourth) medicine bag 153 when using a new process cartridge 7*n*.

Additionally, as illustrated in FIG. 14A, in an environment in which the temperature and humidity are 15° C. and 10%, respectively, when ΔI=5 and 8, no final product defects arise in the four medicine bags 153 when using a new process cartridge 7*n*. However, a final product defect arises in the final medicine bag 153 when ΔI=3. Furthermore, in an environment in which the temperature and humidity are 15° C. and 10%, respectively, when ΔI=8, no final product defects arise in the four medicine bags 153 when using a process cartridge 7*n* at the end of its lifespan. However, a final product defect arises in the final two medicine bags 153 when ΔI=3, and a final product defect arises in the final medicine bag 153 when ΔI=5. Note that in the image forming apparatus 1 according to the present embodiment, ΔI=8 corresponds to one rotation of the transport member 108.

It is thought that the reason why final product defects are more likely to occur as the temperature and humidity drop is because the flowability of the powder adhesive Tn decrease. Specifically, in low-temperature and low-humidity environments, a high charge can arise in the powder adhesive Tn. When highly-charged powder adhesive Tn is present, powder adhesive Tn having a relatively low charge gathers around the highly-charged powder adhesive Tn more easily and forms compact clusters. This causes a drop in the flowability of the powder adhesive Tn, and a drop in the amount of the powder adhesive Tn supplied from the supply roller 106 to the developing roller 105, which in turn is thought to cause the occurrence of final product defects.

One of the reasons why final product defects are more likely to occur as the process cartridge 7*n* approaches the end of its life is thought to be the precipitation of external additives in the powder adhesive Tn caused by changes in the process cartridge 7 over time. When external additives of the powder adhesive Tn precipitate, the flowability of the powder adhesive Tn decreases, which in turn reduces the amount of powder adhesive Tn supplied to the developing roller 105. Another reason why final product defects are more likely to occur as the process cartridge 7*n* approaches the end of its life is thought to be a decrease in the remaining amount of the powder adhesive Tn leading to a decrease in the amount of the powder adhesive Tn supplied to the supply roller 106 by the transport member 108 as well.

Accordingly, the control unit 100 can control the increase amount ΔI on the basis of environment information detected by the temperature/humidity sensor 16. For example, the relationship between temperature and/or humidity and the increase amount ΔI is determined in advance and stored in a storage device of the control unit 100. Then, the control unit 100 can determine the increase amount ΔI on the basis of the temperature and/or humidity detected by the temperature/humidity sensor 16 when forming a powder image on the sheet P. In this case, the configuration can be such that the increase amount ΔI is increased in steps as the temperature and/or humidity decreases. A configuration in which the increase amount ΔI is controlled in accordance with deterioration of the process cartridge 7*n* can also be employed. Specifically, the control unit 100 manages an evaluation value for evaluating the deterioration of the process cartridge 7*n*. A usage period of the process cartridge 7*n*, a cumulative number of rotations of the developing roller 105 of the process cartridge 7*n*, a number of sheets P on which the first type of powder image has been formed, the total amount of powder adhesive Tn supplied to the sheets P, or the like can be used as the evaluation value. When the evaluation value increases, the control unit 100 can increase the increase amount ΔI in steps. The configuration may also be such that the increase amount ΔI is determined taking into account both the environment information and the deterioration of the process cartridge 7*n*. The increase amount ΔI can also be set to always be a predetermined amount. For example, from the results illustrated in FIG. 14A, it can be assumed that ΔI=8, for which no final product defects occur, is constant regardless of the state of the process cartridge 7, the temperature and humidity, and so on.

Note that in the present embodiment, when the first type of powder image is formed on both the preceding sheet and the following sheet, the sheet interval between the preceding sheet and the following sheet is made wider than the standard interval R regardless of the adhesive region of the preceding sheet and the adhesive region of the following sheet. However, a configuration can also be employed in which when the adhesive region 154 (a first adhesive region) of the preceding sheet and the adhesive region 155 (a second adhesive region) of the following sheet meet an expansion condition, which is a predetermined condition, the sheet interval between the preceding sheet and the following sheet is made wider than the standard interval R. For example, both the adhesive regions of the preceding sheet and the following sheet having a first region and a second region in which the powder adhesive Tn is caused to adhere continuously in the conveyance direction, and ranges of the first region and the second region overlapping in the width direction, can be taken as one expansion condition. When the expansion condition is not met, the powder adhesive Tn is not supplied continuously to the preceding sheet and the following sheet from the same position of the developing roller 105. This makes it difficult for a situation in which the required amount of the powder adhesive Tn is not supplied to the sheets P to arise. As such, a configuration is possible in which the sheet interval is controlled to the standard interval R when the expansion condition is not met, even if the first type of powder image is formed on both the preceding sheet and the following sheet. Note that the consecutive lengths, in the conveyance direction, of the first region and the second region that will meet the expansion condition is determined in advance. For example, a configuration is possible in which at least the expansion condition is met when the length, in the conveyance direction, of the first region, the second region, or both spans the entire sheet P.

Although the present embodiment has been described in the context of controlling the sheet interval, the sheet interval can be replaced with an image formation timing. In other words, increasing the sheet interval between the preceding sheet and the following sheet is equivalent to delaying the image formation timing for the following sheet by the time required to conveyance the sheet P by ΔI from the image formation timing when the sheet interval is the standard interval R. The "image formation timing" is the timing at which the exposure of each photosensitive member 101 starts in order to form an electrostatic latent image on that photosensitive member 101.

As described above, by controlling the sheet interval between the preceding sheet and the following sheet, or the image formation timing of the following sheet, a situation where the required amount of powder adhesive Tn is not supplied to the sheet P can be prevented, and final product defects can therefore be suppressed.

Third Embodiment

Next, a third embodiment will be described, focusing on the differences from the second embodiment. The second embodiment described controlling the sheet interval or the image formation timing of the following sheet when forming a powder image on a plurality of sheets P in a single print job. The present embodiment will describe control performed between different print jobs.

Figure 15A:
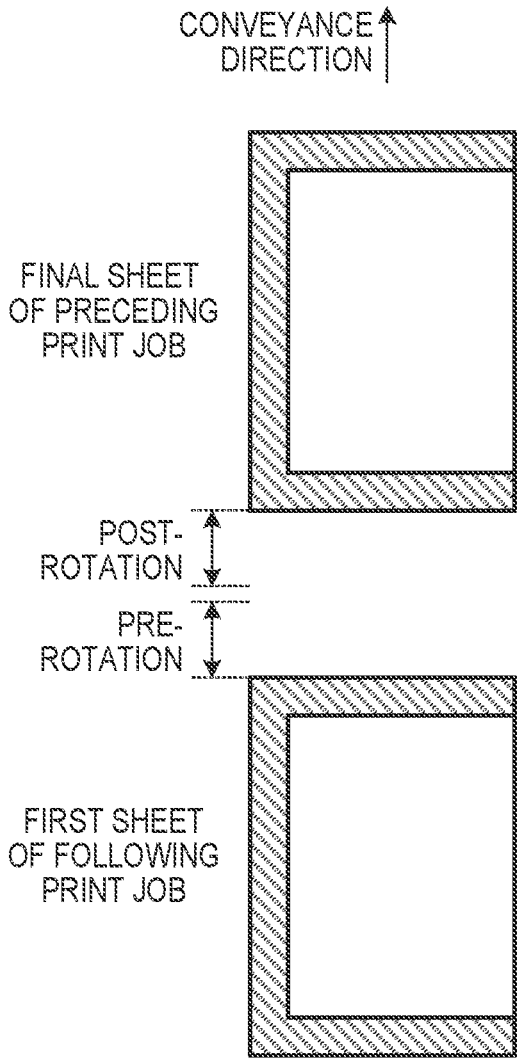
FIGS. 15A and 15B are descriptive diagrams illustrating post-rotation control according to an embodiment.

As illustrated in FIG. 15A, after the final sheet P of a preceding print job has been processed, the image forming apparatus 1 executes preliminary operations (post-rotation) after the image formation. Specifically, in the post-rotation, the image forming apparatus 1 turns off each voltage used for image formation, such as the developing voltage; separates the developing roller 105 from the photosensitive member 101; and stops the rotation of the developing roller 105, the photosensitive member 101, and the like. Additionally, as illustrated in FIG. 15A, before processing the first sheet P of a following print job, the image forming apparatus 1 executes preliminary operations (pre-rotation) before the image formation. Specifically, in the pre-rotation, the image forming apparatus 1 turns on each voltage used for image formation, such as the developing voltage; causes the developing roller 105, the photosensitive member 101, and the like to rotate; and brings the developing roller 105 into contact with the photosensitive member 101.

Figure 15B:
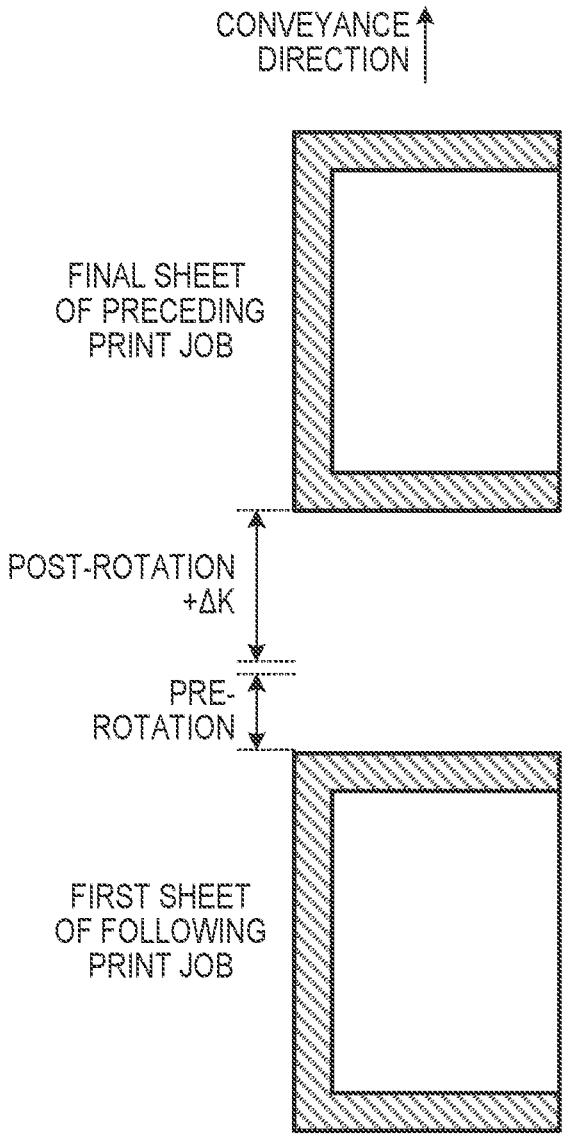

The powder adhesive Tn is supplied to the developing roller 105 until the developing roller 105 stops in the post-rotation and after the developing roller 105 is rotated in the pre-rotation. However, if this supply amount is insufficient, a sufficient amount of the powder adhesive Tn will not be supplied for the first sheet P in the following job, and final product defects can therefore arise. However, according to the present embodiment, as illustrated in FIG. 15B, when a first type of powder image is formed on the final sheet P of the preceding job, the rotation number (the number of rotation) until the developing roller 105 stops in the post-rotation is increased by AK from the standard rotation number (the standard number of rotation). Note that the "the standard rotation number" is the rotation number of the developing roller 105 in the post-rotation when the second type of powder image is formed on the final sheet P of the preceding job. According to this configuration, a sufficient amount of the powder adhesive Tn is supplied to the developing roller 105 at the start of the following job.

FIG. 14B illustrates a result of a case where four print jobs have been loaded consecutively, with each print job forming one of the medicine bags 153 illustrated in FIG. 11C. As illustrated in FIG. 14B, when ΔK=2, no final product defects arise in the four medicine bags 153. However, when ΔK=0 as a comparative example, a final product defect arises in the final (the fourth) medicine bag 153. Note that FIG. 14B illustrates a result for a case where a new process cartridge 7*n* is used in an environment in which the temperature and humidity are 23° C. and 50%, respectively.

In the present embodiment, the first type of powder image being formed on the final sheet P of the preceding job is used as a condition for increasing the rotation number of the developing roller 105 in the post-rotation beyond the standard rotation number. However, a configuration can be employed in which the rotation number of the developing roller 105 in the post-rotation is controlled to the standard rotation number if the following job is loaded in the image forming apparatus 1 before the end of the preceding job and the second type of powder image is formed on the first sheet P of the following job. Furthermore, a configuration can be employed in which the rotation number of the developing roller 105 in the post-rotation is controlled to the standard rotation number if developer regions in the final sheet P of the preceding job and the first sheet of the following job do not meet an expansion condition, even if the first type of powder image is formed on the first sheet P of the following job. This is because in such a case, it is not necessary to supply the powder adhesive Tn continuously to the photosensitive member 101 from the same position of the developing roller 105 for both the final sheet P of the preceding job and the first sheet P of the following job.

The rotation number of the developing roller 105 is increased in the post-rotation rather than the pre-rotation in order to shorten the period from when the following job is loaded in the image forming apparatus 1 to when the following job is started. However, a configuration is also possible in which a sufficient amount of the powder adhesive Tn is supplied to the developing roller 105 before forming the powder image in the following job by rotating the developing roller 105 at a higher rotating number than the standard rotation number in the pre-rotation.

In this case, the first type of powder image being formed on the first sheet P of the following job can be used as a condition for increasing the rotation number of the developing roller 105 in the pre-rotation beyond the standard rotation number. Note that the "standard rotation number" is the rotation number of the developing roller 105 in the pre-rotation when the second type of powder image is formed on the first sheet P of the following job. Furthermore, in addition to forming the first type of powder image on the first sheet P of the following job, forming the first type of powder image on the final sheet P of the preceding job can be used as a condition for increasing the rotation number of the developing roller 105 in the pre-rotation beyond the standard rotation number. Furthermore, as described in the second embodiment, the developer regions of the final sheet P of the preceding job and the first sheet P of the following job meeting an expansion condition can be added to the conditions for increasing the rotation number of the developing roller 105 in the pre-rotation beyond the standard rotation number. Additionally, the first type of powder image being formed on the final sheet P of the preceding job can be used as a condition for increasing the rotation number of the developing roller 105 in the pre-rotation beyond the standard rotation number. In this case, when the second type of powder image is formed on the final sheet P of the preceding job, the control unit 100 controls the rotation number of the developing roller 105 in the pre-rotation to the standard rotation number.

Accordingly, when a predetermined condition is met, the developing roller 105 is rotated more than the standard rotation number in the post-rotation or the pre-rotation. According to this configuration, a situation where the required amount of the powder adhesive Tn is not supplied to the sheet P can be prevented, which makes it possible to suppress the occurrence of final product defects. Note that rotating the developing roller 105 more than the standard rotation number corresponds to increasing the interval between the final sheet P of the preceding job and the first sheet P of the following job, when the preceding job and the following job are consecutive, beyond an interval used when the developing roller 105 is rotated at the standard rotation number. Furthermore, rotating the developing roller 105 more than the standard rotation number corresponds to delaying the image formation timing for the first sheet P of the following job, when the preceding job and the following job are consecutive, from the image formation timing used when the developing roller 105 is rotated at the standard rotation number.

Fourth Embodiment

Next, a fourth embodiment will be described, focusing on the differences from the second embodiment. In the second embodiment, the sheet interval was controlled on the basis of the types of the powder images formed on the preceding sheet and the following sheet. In other words, in the second embodiment, even if the first type of powder image is formed on three consecutive sheets P, the number of consecutive sheets is not taken into account when determining the sheet interval. In the present embodiment, the sheet interval is controlled in accordance with the number of consecutive times the first type of powder image is formed on the sheets P.

Figure 16:
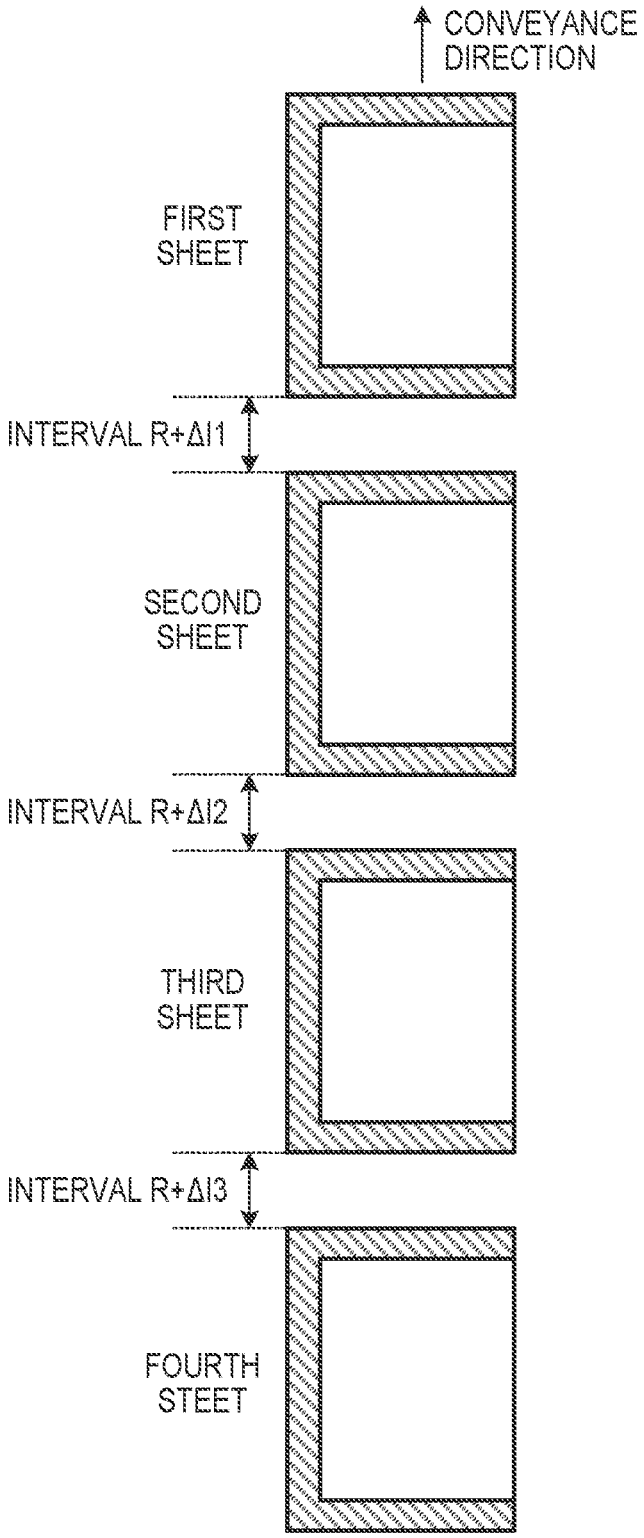
FIG. 16 is a descriptive diagram illustrating sheet interval control according to an embodiment.

FIG. 16 illustrates the sheet intervals when the first type of powder image is formed on four consecutive sheets P. Note that the first sheet P in FIG. 16 is the first sheet P in the print job, or is a sheet P for which the second type of powder image is formed on the preceding sheet P. As illustrated in FIG. 16, an increase amount in the sheet interval between the first and second sheets is represented by ΔI1, an increase amount in the sheet interval between the second and third sheets is represented by ΔI2, and an increase amount in the sheet interval between the third and fourth sheets is represented by ΔI3. The increase amounts ΔI1, ΔI2, and ΔI3 are determined in advance and stored in a storage device of the control unit 100. In the following, these three increase amounts will be referred to as "ΔI1/ΔI2/ΔI3". Additionally, like the second embodiment, the increase amounts ΔI1, ΔI2, and ΔI3 are expressed as multiples of the circumference of the developing roller 105.

As described in the second embodiment, in an environment in which the temperature and humidity are 23° C. and 50%, respectively, when the increase amount ΔI is set to 0 and a new process cartridge 7*n* is used to form four consecutive medicine bags 153, a final product defect arises in the fourth medicine bag 153. On the other hand, in an environment in which the temperature and humidity are 23° C. and 50%, respectively, when the increase amounts are "0.5/0.5/2" and a new process cartridge 7*n* is used, no final product defects arise in the four medicine bags 153. When there are five or more consecutive sheets P on which the first type of powder image is formed, the increase amount for the sheet intervals after the fourth sheet can be kept constant at ΔI3=2, which is the third (final) increase amount. Although the present embodiment defines the first to third increase amounts ΔI1 to ΔI3, a configuration can also be employed in which for any value n greater than or equal to 2, increase amount information defining first to nth increase amounts is determined in advance and stored in a storage device of the control unit 100.

Note that the increase amount information "0.5/0.5/2" is one example, and the present invention is not limited to such increase amount information. However, the increase amount for a given sheet interval is set to the same as or greater than the increase amount of the sheet interval one previous. For example, the increase amount information can be set to "0.5/1/1". In this case, when there are three consecutive sheets P on which the first type of powder image is formed, the sheet interval between the first and second sheets is increased by 0.5, whereas the sheet interval between the second and third sheets is increased by 1.

Additionally, for example, the increase amount information can be set to "0/0/3". This corresponds to increasing the sheet interval from the sheet interval between the third and fourth sheets when there are four or more consecutive sheets P on which the first type of powder image is formed. As described in the second embodiment, in an environment in which the temperature and humidity are 23° C. and 50%, respectively, when the increase amount ΔI is set to 0 and a new process cartridge 7*n*, no final product defects arise in the first to third medicine bags 153 even if four medicine bags 153 are formed consecutively. Therefore, when such characteristics are in effect, no problems arise even if the first increase amount ΔI1 and the second increase amount ΔI2 are set to 0, and productivity can be increased by not expanding the interval. Note that "0/0/3" is merely an example, and a configuration can be employed in which the sheet interval begins to be expanded beyond the standard interval R when sheets P on which the first type of powder image is formed continue for at least a predetermined number of times.

According to the present embodiment, a relationship between the number of consecutive times for which it is determined to increase the sheet interval beyond the standard interval R, and the increase amount ΔI, is determined in advance, and stored in the control unit 100 as the increase amount information. This configuration makes it possible to suppress final product defects while increasing productivity. The increase amount ΔI is increased in steps as the number of consecutive times increases. As mentioned above, the increase amount ΔI for the first predetermined number of times can be set to 0. This corresponds to expanding the sheet interval beyond the standard interval R when sheets P on which the first type of powder image is formed continue for at least a predetermined number of times. The expansion conditions described in the second embodiment can also be used in the present embodiment. Specifically, a configuration can be employed in which when the preceding sheet and the following sheet meet the expansion condition, the control unit 100 determines the increase amount ΔI on the basis of the number of consecutive times the expansion condition is met and the increase amount information.

Furthermore, the environment information, evaluation values for evaluating deterioration of the process cartridge 7*n*, and the like described in the second embodiment can be taken into account as well. For example, a configuration can be employed in which the increase amount information is determined in advance for each instance of environment information and/or evaluation value, and is stored in the control unit 100. Additionally, for example, a configuration can be employed in which information indicating a method for correcting each increase amount ΔI in the increase amount information is determined in advance on the basis of the environment information and/or the evaluation value, and is stored in the control unit 100.

Other

The foregoing second embodiment to fourth embodiment were described using, as an example, an image forming apparatus that forms a powder image using toner and a powder adhesive. However, the second embodiment to fourth embodiment can also be realized as adhesion apparatuses that use only a powder adhesive, as in the first embodiment. The adhesion apparatus increases the sheet interval between the preceding sheet and the following sheet beyond a standard interval when the expansion condition described in the first embodiment is met, when the powder adhesive is caused to adhere to a plurality of sheets in a single job. In other words, the sheet interval is expanded beyond the standard interval when the powder adhesive Tn adheres to both the preceding sheet and the following sheet continuously in the conveyance direction, and the ranges, in the width direction, where the powder adhesive Tn adheres overlap continuously in the conveyance direction.

Additionally, the adhesion apparatus controls the rotation number of the developing roller 105 in the post-rotation to the standard rotation number when a following job is loaded before the preceding job has ended, and the final sheet of the preceding job and the first sheet of the following job do not meet the expansion condition. On the other hand, the control unit 100 increases the rotation number of the developing roller 105 beyond the standard rotation number when the expansion condition is met. Alternatively, when the final sheet of the preceding job and the first sheet of the following job meet the expansion condition, the adhesion apparatus increases the rotation number of the developing roller 105 in the pre-rotation beyond the standard rotation number. Note that when the final sheet of the preceding job and the first sheet of the following job do not meet the expansion condition, the adhesion apparatus controls the rotation number of the developing roller 105 in the pre-rotation to the standard rotation number.

The second embodiment and the fourth embodiment described controlling the sheet interval or the image formation timing of the following sheet when continuously forming powder images on a plurality of sheets P. The following is a supplementary explanation of the conveyance control of the sheets P when forming powder images on a plurality of sheets P consecutively. First, when forming a powder image on only one side of each of the plurality of sheets P, the plurality of sheets P are only conveyed to the position opposing the secondary transfer roller 5 in order (single-sided control). When forming a powder image on both sides of the plurality of sheets P, there are two types of control: control that conveys the sheet such that after a powder image as been formed on one side of a given sheet, a powder image is formed on another sheet before forming a powder image on the other side of the stated sheet (first double-sided control); and control that conveys the sheets so that a powder image is not formed on the other sheet (second double-sided control).

The present invention can be applied in any of the above-described single-sided control, first double-sided control, and second double-sided control. In the case of the single-sided control and the first double-sided control, the two consecutive sheets P onto which the image forming section transfers the powder images are different sheets P. In other words, the preceding sheet and the following sheet are different sheets P. On the other hand, in the case of the second double-sided control, two consecutive sheets P may be the same sheet. Specifically, the image forming section forms a powder image on a first side (the front side) of a given sheet P, then forms a powder image on a second side (the rear side) of the same sheet P, and then forms a powder image on the first side (the front side) of another sheet P. In this case, the preceding sheet and the following sheet can be the same sheet P. In the case of the second double-sided control, the present invention can also be applied with the sheet P on which a powder image is formed on both sides first serving as the preceding sheet, and the sheet P on which a powder image is formed on both sides after the preceding sheet serving as the following sheet. Note that the standard interval R in the second embodiment and the fourth embodiment may be different in each of the single-sided control, the first double-sided control, and the second double-sided control.

Furthermore, the first double-sided control can be mixed with the second double-sided control. For example, a configuration can be employed in which the first double-sided control is used when forming the second type of powder image on both sides of the sheet P, and the second double-sided control is used for a sheet P in which the second type of powder image is formed on the first side but the first type of powder image is formed on the second side. In the case of a sheet P in which the first type of powder image is formed on the second side, no powder images are formed on other sheets P during the period from when the powder image is formed on the first side to when the powder image is formed on the second side, and thus the sheet interval increases. Accordingly, during the period from when the powder image is formed on the first side to when the powder image is formed on the second side, the rotation number of the developing roller 105 increases and the powder adhesive Tn can be supplied to the developing roller 105.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-130772, filed Jul. 31, 2020 and Japanese Patent Application No. 2020-130773, filed Jul. 31, 2020 which are hereby incorporated by reference herein in their entirety.

What is claimed is:

1. An adhesion apparatus comprising:

an image forming unit configured to form, through an electrophotographic process, an adhesive image of a powder adhesive on a sheet that is conveyed; and a control unit configured to control the image forming unit to use a first pattern in a first conveyance period, and use a second pattern different from the first pattern in a second conveyance period following the first conveyance period, as a formation pattern in an adhering section corresponding to part of a width direction orthogonal to a conveyance direction of the sheet, wherein the adhering section includes a first adhering section located at one end of the sheet in the width direction and a second adhering section located at another end of the sheet in the width direction, the first pattern is a pattern that causes the powder adhesive to adhere to the sheet continuously along the conveyance direction in the first adhering section, and does not cause the powder adhesive to adhere to the sheet in the second adhering section, the second pattern is a pattern that causes the powder adhesive to adhere to the sheet continuously along the conveyance direction in the second adhering section, and does not cause the powder adhesive to adhere to the sheet in the first adhering section, and the first conveyance period is a period for forming the adhesive image on a first sheet, and the second conveyance period is a period for forming the adhesive image on a second sheet that follows the first sheet.

2. The adhesion apparatus according to claim 1, wherein the image forming unit is further configured to form a toner image on the sheet through the electrophotographic process, and the control unit is configured to control the image forming unit such that when a same toner image is requested to be formed on the first sheet and the second sheet, the image forming unit forms a rotated toner image on the second sheet, the rotated toner image being the toner image formed on the first sheet rotated by 180 degrees.

3. The adhesion apparatus according to claim 1, wherein the image forming unit includes a photosensitive member on which an electrostatic latent image is formed, and a developing roller that supplies the powder adhesive for developing the electrostatic latent image to the photosensitive member, the control unit is further configured to control the image forming unit such that the powder adhesive is not supplied to the photosensitive member throughout the first conveyance period in the second adhering section, and the powder adhesive is not supplied to the photosensitive member throughout the second conveyance period in the first adhering section, and a length of each of the first conveyance period and the second conveyance period is greater than or equal to a rotation period of the developing roller.

4. The adhesion apparatus according to claim 3, wherein the image forming unit further includes a holding part that holds the powder adhesive supplied to the developing roller, and the powder adhesive is supplied from the holding part to the developing roller throughout the first conveyance period and the second conveyance period.

5. The adhesion apparatus according to claim 1, wherein the image forming unit is further configured to form a toner image on the sheet through the electrophotographic process.

6. The adhesion apparatus according to claim 1, further comprising:

a folding unit configured to fold the sheet on which the adhesive image has been formed by the image forming unit; and a heating unit configured to heat and pressurize the sheet folded by the folding unit.

7. The adhesion apparatus according to claim 6, further comprising:

a fixing unit configured to fix the adhesive image onto the sheet by heating and pressurizing the sheet on which the adhesive image has been formed by the image forming unit, wherein the folding unit is provided downstream from the fixing unit in the conveyance direction of the sheet.

8. The adhesion apparatus according to claim 6, wherein the heating unit is configured to adhere opposing regions of the sheet that has been folded to each other by heating and re-melting the powder adhesive adhering to the sheet in the adhering section, and by providing a non-adhering section in the width direction, the sheet has a bag shape after the adhering by the heating unit.

* * * * *